US008167394B2

(12) United States Patent
Terada

(10) Patent No.: US 8,167,394 B2
(45) Date of Patent: May 1, 2012

(54) IMAGE RECORDING APPARATUS AND CALCULATION METHOD

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 393 days.

(21) Appl. No.: 12/542,596

(22) Filed: Aug. 17, 2009

(65) Prior Publication Data

US 2010/0039473 A1 Feb. 18, 2010

(30) Foreign Application Priority Data

Aug. 18, 2008 (JP) ..... 2008-210087

(51) Int. Cl.
*B41J 25/308* (2006.01)

(52) U.S. Cl. ..... 347/8; 347/5; 347/19

(58) Field of Classification Search ..... 347/5, 8, 347/9, 14, 15, 19
See application file for complete search history.

(56) References Cited

U.S. PATENT DOCUMENTS

| | | | | |
|---|---|---|---|---|
| 7,441,849 | B2 | 10/2008 | Sasa et al. | |
| 2004/0080553 | A1* | 4/2004 | Kim | 347/8 |
| 2004/0246284 | A1 | 12/2004 | Murai et al. | |
| 2007/0047157 | A1 | 3/2007 | Miyahara et al. | |

FOREIGN PATENT DOCUMENTS

| | | | |
|---|---|---|---|
| JP | 2004-322515 | A | 11/2004 |
| JP | 2006-168138 | A | 6/2006 |
| JP | 2006-305479 | A | 11/2006 |
| JP | 2007-062219 | A | 3/2007 |
| JP | 2007-091467 | A | 4/2007 |
| JP | 2007-331315 | A | 12/2007 |

OTHER PUBLICATIONS

Japan Patent Office, Notification of Reason for Refusal for Patent Application No. JP2008-210087, mailed Aug. 17, 2010. (Counterpart to above-captioned U.S. patent application.)

* cited by examiner

*Primary Examiner* — Lam S Nguyen
(74) *Attorney, Agent, or Firm* — Baker Botts L.L.P.

(57) ABSTRACT

An image recording apparatus, including: a platen which supports a sheet; a movable carriage disposed so as to face to the platen; a head mounted on the carriage to record an image on the sheet; an optical sensor mounted on the carriage and constituted by an emitting element which emits light and a receiving element which receives light reflected from the sheet and output an electric signal according to intensity of the reflected light; a changing mechanism which changes the optical sensor between first and second positions; and a calculation section which calculates at least one of a distance between the optical sensor and the sheet and a reflectivity of the sheet on the basis of (a) a first electric signal outputted from the receiving element with the optical sensor disposed at the first position and (b) a second electric signal outputted from the receiving element with the optical sensor disposed at the second position.

19 Claims, 11 Drawing Sheets

IMAGE RECORDING APPARATUS AND CALCULATION METHOD

CROSS REFERENCE TO RELATED APPLICATION

The present application claims priority from Japanese Patent Application No. 2008-210087, which was filed on Aug. 18, 2008, the disclosure of which is herein incorporated by reference in its entirety.

BACKGROUND OF THE INVENTION

1. Field of the Invention

The present invention relates to an image recording apparatus and a calculation method which can obtain a distance from an optical sensor mounted on a carriage to a surface of a sheet on a platen, or a light reflectivity of the surface of the sheet, using the optical sensor constituted by only a pair of a light emitting element and a light receiving element.

2. Description of the Related Art

In an ink-jet recording apparatus, an image is recorded on a recording sheet by ejecting an ink from a recording head toward the recording sheet fed along a sheet-feed path. An optical sensor is mounted on a carriage with the recording head. As the optical sensor, there is generally used, e.g., a sensor including an LED as a light emitting element and a photo transistor as a light receiving element which are constructed integrally with each other. A light emitted from the light emitting element is reflected from the recording sheet or a platen which supports the recording sheet, and part of the light is received by the light receiving element and converted to a voltage. The platen is provided by a black member and has a lower light reflectivity than a surface of the recording sheet on which the image is not recorded. Thus, a position at which an output voltage outputted from the light receiving element is greatly changed is detected, whereby a position of an end portion of the recording sheet can be detected.

The above-described light emitted from the light emitting element reaches a reflecting surface while diffusing, and then part of the light reaches the light receiving element while further diffusing. An amount (a light receiving amount) of the light received by the light receiving element at this time is the largest in a case in which the light emitted from a center of the light emitting element along an optical axis reaches a center of the light receiving element. The light receiving amount decreases in accordance that a position at which the light reaches becomes distant from the center of the light receiving element. In other words, a ratio of the light received by the light receiving element in entire reflected light is determined by a distance between a barycenter of the reflected light (i.e., a central position of the reflected light in a plane of the light receiving element where it is assumed that all reflected light has reached the plane of the light receiving element) and the center of the light receiving element. Where the distance between the barycenter of the reflected light and the center of the light receiving element is constant, and light-emission intensity of the above-described light emitting element is constant, the output voltage outputted from the light receiving element is determined by a light reflectivity of the reflecting surface. The surface of the recording sheet is white or other bright colors and thus has a relatively high light reflectivity. In particular, a glossy sheet has a higher reflectivity than a normal sheet. Thus, the output voltage outputted from the light receiving element in a case in which the light emitted from the light emitting element is reflected from the glossy sheet is higher than the output voltage outputted from the light receiving element in a case in which the light emitted from the light emitting element is reflected from the normal sheet. Thus, a type of the recording sheet can be judged on the basis of a magnitude of the output voltage outputted from the light receiving element.

Further, where the above-described light-emission intensity of the light emitting element is constant, and the reflectivity of the reflecting surface is constant, the output voltage outputted from the light receiving element is determined by the distance between the barycenter of the reflected light and the center of the light receiving element.

Meanwhile, where a thickness of the recording sheet used in image recording is changed, a length of time in which the ink ejected from the recording head is attached to the recording sheet on the platen is changed. This cause a problem that an image recorded on the recording sheet is distorted because the ink is attached to a position displaced or distant from a desired position. To solve this problem, there is a need to perform proper image recording by a method that a timing at which the ink is ejected from the recording head is changed on the basis of the thickness of the recording sheet, for example. Thus, with reference to Patent Documents 1-4, a conventional image recording apparatus is provided with a means for detecting the thickness of the recording sheet supplied to the sheet-feed path.

A recording apparatus disclosed in Patent Document 1 (US 2007/0047157 A1 corresponding to JP-A-2007-91467) includes a multi-purpose sensor. This multi-purpose sensor is mounted on a carriage with a recording head and includes one infrared LED and two phototransistors. The infrared LED is a light emitting element disposed so as to emit light at 45° with respect to a measuring surface (i.e., a surface of a platen or a surface of a recording sheet). Each of the two phototransistors is a light receiving element disposed such that a light receiving axis is parallel to a central axis of a reflected light. Each of the two phototransistors is disposed in a state in which an optical axis of each phototransistor is displaced from the infrared LED. Thus, output voltages outputted from the two phototransistors are greatly changed in accordance with a distance from the multi-purpose sensor to the measuring surface. In this recording apparatus, where the output voltages of the respective phototransistors have been obtained, a distance coefficient is obtained on the basis of the two output voltages. The recording apparatus has a table representative of a relationship between the distance coefficient obtained by calculation and the distance from the multi-purpose sensor to the measuring surface. Thus, in the recording apparatus, the distance from the multi-purpose sensor to the measuring surface, i.e., a distance from the multi-purpose sensor to a surface of the recording sheet can be obtained on the basis of the table and the distance coefficient obtained in the above-described manner. A thickness of the recording sheet is obtained by subtracting the thus obtained distance from the distance from the multi-purpose sensor to the platen.

A recording apparatus disclosed in Patent Document 2 (JP-A-2007-62219) includes an optical sensor which is similar to the multi-purpose sensor disclosed in Patent Document 1. An uneven surface is formed in an end portion of a platen as a surface from which light emitted from an infrared LED is reflected. A sensitivity of two phototransistors is corrected on the basis of output voltages of the respective two phototransistors in a case in which projecting portions and depressed portions of the uneven surface are used as a reflecting surface. Thus, it is possible to obtain a thickness of a recording sheet more accurately than in the recording apparatus disclosed in Patent Document 1.

A recording apparatus disclosed in Patent Document 3 (JP-A-2006-168138) includes an LED as a light emitting element and a line sensor as a light receiving element. The LED and the line sensor are mounted on a carriage which is reciprocable in a direction perpendicular to a sheet-feed direction of a recording sheet. In this recording apparatus, light is emitted from the LED to the recording sheet fed along a sheet-feed path. Reflected light of this emitted light is received by the line sensor. A position of the line sensor at which an output voltage based on the reflected light is the largest is obtained on the basis of an output signal outputted from each element of the line sensor. Then, a distance between the recording sheet and the line sensor is obtained on the basis of this positional information. On the basis of this distance, a distance between the recording head and the recording sheet, and the thickness of the recording sheet are obtained.

A recording apparatus disclosed in Patent Document 4 (U.S. Pat. No. 7,441,849 B2 corresponding to JP-A-2006-305479) includes an LED as a light emitting element and a light receiving element. The light emitting element is disposed on an outside of an area in which a recording sheet is fed and emits light slantly relative to a platen. The light receiving element is mounted with a recording head on a carriage which is reciprocable in a direction perpendicular to a sheet-feed direction of a recording sheet. In this recording apparatus, the carriage is moved in a direction in which the light receiving element is moved toward or nearer to the light emitting element, and light is emitted from the light emitting element. Where the recording sheet supplied to the sheet-feed path has reached a position on the platen, the light emitted from the light emitting element is reflected not from the platen but from a surface of the recording sheet. A controller of the recording apparatus detects a position of the carriage when the light receiving element has received this reflected light. The position of the carriage when the light receiving element has received the reflected light emitted from the light emitting element is changed in accordance with a distance between the recording head and the recording sheet. Thus, the distance between the recording head and the recording sheet is obtained on the basis of the position of the carriage which has been detected in the above-described manner. A thickness of the recording sheet can be obtained on the basis of (a) this distance between the recording head and the recording sheet and (b) a distance from the recording head to the platen.

SUMMARY OF THE INVENTION

In each apparatus disclosed in Patent Documents 1 and 2, the two phototransistors are provided each as the light receiving element. Further, in the recording apparatus disclosed in Patent Document 3, the line sensor is provided as the light receiving element. Thus, the apparatus is unfortunately upsized in addition to an increase in cost of the apparatus. Further, in the recording apparatus disclosed in Patent Document 3, a distance between the recording head and the surface of the recording sheet is obtained on the basis of the output signal outputted from each element of the line sensor, thereby posing a problem that a signal processing becomes more complicated. In the apparatus disclosed in Patent Document 4, intensity of the reflected light received by the light receiving element is changed in accordance with the position of the carriage, but it is impossible to distinguish whether this change of a light receiving amount is caused by a difference in the distance between the carriage and the platen or by a difference in a reflectivity of the surface of the recording sheet. Thus, there is a problem that the obtained distance from the recording head to the recording sheet is not always accurate. In order to manufacture an apparatus which can accurately obtain the distance from the recording head to the recording sheet with relatively low cost, it is preferable to use an optical sensor constituted by a pair of the light emitting element and the light receiving element.

This invention has been developed in view of the above-described situations, and it is an object of the present invention to provide an image recording apparatus and a calculation method which can obtain a distance from an optical sensor mounted on a carriage to a surface of a sheet, or a light reflectivity of the surface of the sheet, using the optical sensor constituted by a pair of a light emitting element and a light receiving element.

The object indicated above may be achieved according to the present invention which provides An image recording apparatus, comprising: a platen configured to support a sheet fed along a predetermined sheet-feed path; a carriage disposed so as to face to the platen and configured to be movable in a first direction intersecting a sheet-feed direction in which the sheet is fed; a recording head mounted on the carriage and configured to record an image on the sheet fed along the platen; an optical sensor mounted on the carriage and constituted by (a) a light emitting element configured to emit light with predetermined intensity toward a surface facing to the recording head and (b) a light receiving element configured to receive light reflected from the surface facing to the recording head and output an electric signal according to intensity of the reflected light; a changing mechanism configured to change a position of the optical sensor between (a) a first position distant from the platen by a first distance and (b) a second position distant from the platen by a second distance which is different from the first distance; and a calculation section configured to calculate at least one of (a) a distance between the optical sensor and a surface of the sheet and (b) a light reflectivity of the surface of the sheet on the basis of a first electric signal and a second electric signal, wherein the first electric signal is outputted from the light receiving element by receiving light reflected from the sheet disposed on the platen by the light receiving element in a state in which the optical sensor is disposed at the first position while the second electric signal is outputted from the light receiving element by receiving the light reflected from the sheet disposed on the platen by the light receiving element in a state in which the optical sensor is disposed at the second position.

The object indicated above may be achieved according to the present invention which provides a calculation method for calculating at least one of (a) a distance between an optical sensor mounted in an image recording apparatus and a surface of a sheet placed in the image recording apparatus and (b) a light reflectivity of the surface of the sheet, comprising the steps of, in the image recording apparatus configured such that a carriage on which the optical sensor constituted by a light emitting element and a light receiving element is mounted is movable in a first direction intersecting a sheet-feed direction in which the sheet is fed: disposing the optical sensor at a first position distant from a platen facing to the carriage by a first distance by moving the carriage relative to the platen in a second direction in which the carriage is moved toward and away from the platen; obtaining a first electric signal outputted from the light receiving element by receiving light reflected from the sheet disposed on the platen by the light receiving element in a state in which the optical sensor is disposed at the first position; disposing the optical sensor at a second position distant from the platen by a second distance which is different from the first distance by moving the carriage relative to the platen in the second direction; obtaining a second electric signal outputted from the light receiving element by receiving the light reflected from the sheet disposed on the platen by the light receiving element in a state in which the optical sensor is disposed at the second position; and calculating at least one of (a) the distance between the optical sensor and the surface of the sheet and (b) the light reflectivity of the surface of the sheet on the basis of the first electric signal and the second electric signal.

In the image recording apparatus constructed as described above and the calculation method, each of distance between the optical sensor and the surface of the sheet on the platen and the light reflectivity of the surface of the sheet is expressed by an equation of the first electric signal and the second electric signal. The distance between the optical sensor and the surface of the sheet on the platen, or the light reflectivity of the surface of the sheet is obtained by substituting measured values of the first electric signal and the second electric signal into the equation. Thus, it is made possible to obtain the distance or the reflectivity using the optical sensor.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which:

FIG. 4A is a schematic cross-sectional view of a carriage 38 and a platen 42 in a state in which a recording sheet 50 is not disposed on the platen 42 while

FIG. 7A is a cross-sectional view taken along line VII-VII in FIG. 5 in a state in which the gap adjusting member 88 is held in contact with contact members 107 while

FIG. 9A is a schematic cross-sectional view of the carriage 38 and the platen 42 in a state in which an optical sensor 70 is disposed at a first position while

DESCRIPTION OF THE PREFERRED EMBODIMENT

Hereinafter, there will be described a preferred embodiment of the present invention by reference to the drawings. It is to be understood that the following embodiment is described only by way of example, and the invention may be otherwise embodied with various modifications without departing from the scope and spirit of the invention.

<General Structure of Multi-function Device 10>

Figure 1:
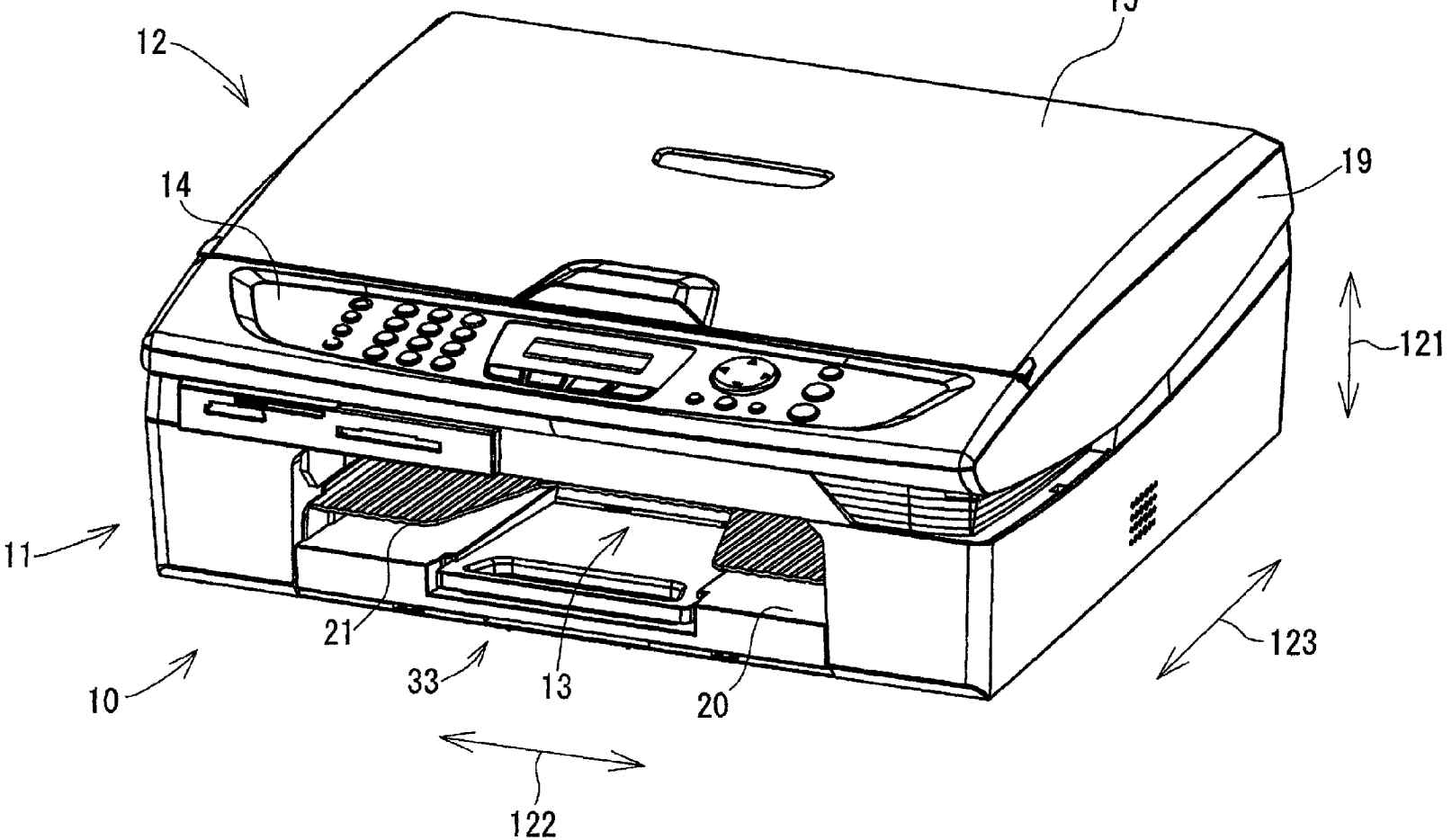
FIG. 1 is an external perspective view showing a multi-function device 10 as an embodiment of an image recording apparatus to which the present invention is applied.

As shown in FIG. 1, a multi-function device (MFD) 10 is wide and slim type with its lengths in a width direction (a first direction) 122 and a depth direction 123 made larger than its length in a height direction (a second direction) 121 and has a generally wide and flat rectangular parallelepiped shape. The MFD 10 includes a printer section 11 and a scanner section 12 integrally with each other and has a printing function, a scanning function, a copying function, a facsimile function, and so on. The printer section 11 corresponds to an image recording apparatus to which the present invention is applied. It is noted that the MFD 10 may not have the scanner section 12 and may be a single-function printer not having the scanning function, the copying function, and so on as the image recording printer to which the present invention is applied.

The printer section 11 is provided at a lower portion of the MFD 10. The printer section 11 is connected to an external information device (not shown) such as a personal computer so as to be communicable with each other. The printer section 11 is configured to record an image on each recording sheet 50 (with reference to FIG. 2) on the basis of data such as recording data received from the external information device and image data of a document which is read by the scanner section 12. As will be described below, in the printer section 11, each recording sheet 50 accommodated in a sheet-supply tray 20 is supplied into the printer section 11. Each recording sheet 50 is discharged onto a sheet-discharge tray 21 after the image is recorded on the recording sheet 50 by a recording portion 24 (with reference to FIG. 2) provided in the printer section 11. It is noted that, in FIG. 2, a part of the sheet-supply tray 20 and the sheet-discharge tray 21 are omitted.

The scanner section 12 is provided at an upper portion of the MFD 10. The scanner section 12 functions as what is called a flat-bed scanner and includes a document table 19 and a document cover 15. The document cover 15 is openable and closable with respect to the document table 19. Though not shown in any figures, a contact glass on which the document is placed is provided on an upper surface of the document table 19. In the document table 19 is disposed a line sensor extending in the depth direction 123 so as to be movable in the width direction 122. The document placed on the contact glass is read as an image by this line sensor. In the present invention, the scanner section 12 may have any suitable structure, and a detailed description of which is dispensed with.

An operational panel 14 is provided on a front upper face of the MFD 10. The operational panel 14 is provided with (a) a display for displaying various information and (b) buttons for an input of the information. The MFD 10 is operated on the basis of command information inputted from the operational panel 14. It is noted that, where the MFD 10 is connected to the external information device, the MFD 10 is operated also on the basis of the command information transmitted from the external information device via a printer driver, a scanner driver, and the like.

<Printer Section 11>

As shown in FIG. 1, an opening 13 is formed at the front side of the printer section 11. A sheet-supply cassette 33 is placed into the printer section 11 through the opening 13. The sheet-supply cassette 33 includes the sheet-supply tray 20 and the sheet-discharge tray 21. The sheet-supply tray 20 and the sheet-discharge tray 21 are disposed so as to have a two-tier structure in a vertical direction in which the sheet-discharge tray 21 is located on or above the sheet-supply tray 20.

The sheet-supply tray 20 is a casing which can accommodate a plurality of the recording sheets 50 in a state in which the recording sheets 50 are stacked on each other. The sheet-supply tray 20 accommodates rectangular recording sheets of a standard size. Among types of the recording sheet 50 are a normal sheet, a glossy sheet, an ink-jet sheet, and so on, but, in the present embodiment, there will be explained a case in which the recording sheet 50 is the normal sheet or the glossy sheet. Further, the sheet-supply tray 20 can accommodate the recording sheets 50 of various sizes such as A4 Size, B5 Size, Postcard Size, and the like, for example.

An inclined plate 22 is provided on a back side (on a right side in FIG. 2) of the sheet-supply tray 20. The inclined plate 22 is inclined toward the back side (on the right side in FIG. 2) of the MFD 10. When the sheet-supply cassette 33 is placed into the printer section 11, the inclined plate 22 is disposed below a sheet-feed path 23. The sheet-feed path 23 extends upward from the inclined plate 22, then curves toward the front side (a left side in FIG. 2) of the MFD 10, and further extends straightly to the sheet-discharge tray 21.

A sheet-supply portion 32 is disposed on an upper side of the sheet-supply tray 20. The sheet-supply portion 32 includes a sheet-supply roller 25, an arm 26, and a shaft 28. The shaft 28 is supported by a frame (not shown) of the printer section 11 in the width direction 122 (i.e., a direction perpendicular to a sheet surface of FIG. 2) as an axial direction of the shaft 28. The arm 26 is rotatably provided on the shaft 28. The sheet-supply roller 25 is rotatably supported by a distal end portion of the arm 26. The arm 26 is biased by its own weight or an elastic force of, e.g., a spring so as to pivot toward the sheet-supply tray 20. Thus, the sheet-supply roller 25 is held in contact with an uppermost one of the recording sheets 50 accommodated in the sheet-supply tray 20 with an appropriate pressure. A drive force of an LF motor 83 (with reference to FIG. 8) is transmitted in this state to the sheet-supply roller 25 via the shaft 28 and a force transmitting mechanism (not shown) provided on the arm 26, thereby rotating the sheet-supply roller 25. The uppermost recording sheet 50 in the sheet-supply tray 20 is fed out to the sheet-feed path 23 along the inclined plate 22 by receiving a rotational force of the sheet-supply roller 25. As a result, the recording sheet 50 is supplied from the sheet-supply tray 20 to the sheet-feed path 23.

A pair of sheet-feed rollers 59 are provided at a midway position of the sheet-feed path 23. The pair of sheet-feed rollers 59 are constituted by a sheet-feed roller 60 and a pinch roller 61. The sheet-feed roller 60 is rotated by the drive force transmitted from the LF motor 83 (with reference to FIG. 8). The pinch roller 61 is rotatably disposed on a lower side of the sheet-feed roller 60 with the sheet-feed path 23 interposed therebetween, and is biased toward the sheet-feed roller 60 by a spring. The recording sheet 50 supplied from the sheet-supply tray 20 to the sheet-feed path 23 is fed in a sheet-feed direction 17 intersecting the width direction 122 by receiving a rotational force of the sheet-feed roller 60 in a state in which the recording sheet 50 is nipped by the sheet-feed roller 60 and the pinch roller 61. It is noted that the sheet-feed direction 17 is a one-way direction which can be expressed by an arrow having one arrow head, while each of the height direction 121, the width direction 122, and the depth direction 123 is a two-way direction which can be expressed by an arrow having two opposite arrow heads, i.e., a direction which can be expressed by a line having directions opposite to each other.

A pair of sheet-discharge rollers 64 are provided on a downstream side of the pair of sheet-feed rollers 59 in the sheet-feed path 23 in the sheet-feed direction 17. The pair of sheet-discharge rollers 64 are constituted by a sheet-discharge roller 62 and a spur roller 63. The sheet-discharge roller 62 is rotated simultaneously with the sheet-feed roller 60 by the drive force transmitted from the LF motor 83. The spur roller 63 is rotatably disposed on an upper side of the sheet-discharge roller 62 with the sheet-feed path 23 interposed therebetween, and is biased toward the sheet-discharge roller 62 by a spring. The recording sheet 50 is fed along the sheet-feed path 23 by receiving a rotational force of the sheet-discharge roller 62 in a state in which the recording sheet 50 is nipped by the sheet-discharge roller 62 and the spur roller 63, and is discharged onto the sheet-discharge tray 21 (with reference to FIG. 1).

A registering sensor 71 is provided on an upstream side of the pair of sheet-feed rollers 59 in the sheet-feed path 23 in the sheet-feed direction 17. The registering sensor 71 detects presence or absence of the recording sheet 50 fed along the sheet-feed path 23. The registering sensor 71 is not especially limited as long as the registering sensor 71 can detect the recording sheet 50. In the present embodiment, the registering sensor 71 is provided by a mechanical sensor. The registering sensor 71 includes a photo interrupter and a detecting element. The photo interrupter includes a light emitting portion which emits light and a light receiving portion which receives the light. The detecting element is supported by a shaft so as to be pivoted by a contact with the recording sheet 50. A light path between the light emitting portion and the light receiving portion is open in a state in which the recording sheet 50 does not contact with the detecting element. When the recording sheet is brought into contact with the detecting element, the light path is closed or intercepted by the detecting element. Thus, a signal level of an electric signal produced by the light receiving portion is changed. A controller 100 (with reference to FIG. 8) which will be described below can judge the presence or absence of the recording sheet 50 at a position P1 on the basis of the change of the electric signal.

<Platen 42>

A platen 42 is provided between the pair of sheet-feed rollers 59 and the pair of sheet-discharge rollers 64. The platen 42 is provided on a lower side of the sheet-feed path 23. The recording sheet 50 fed along the sheet-feed path 23 is supported by the platen 42 from below when passing through a position under the recording portion 24. The platen 42 is formed to have a black color, and a light reflectivity of a surface thereof is relatively small. In many cases, a surface of the recording sheet 50 before the image has been recorded is white or other bright colors and thus has a relatively high light reflectivity. That is, the platen 42 is configured such that the light reflectivity of the surface thereof is smaller than that of the surface of the recording sheet 50. It is noted that the color of the platen 42 is not limited to black, and may be a color other than black.

<Carriage 38>

Figure 2:
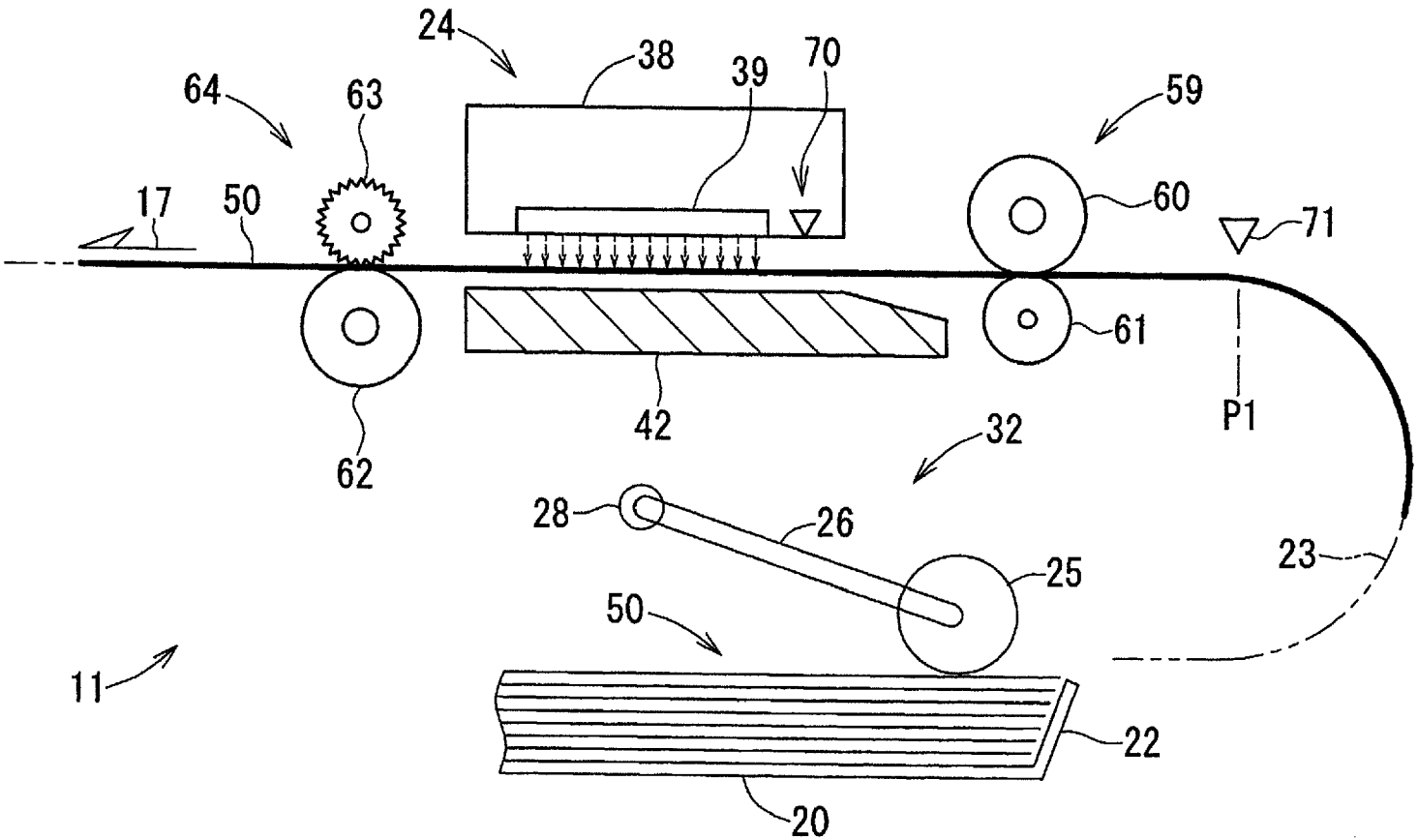
FIG. 2 is a schematic view showing an internal structure of a printer section 11 of the multi-function apparatus 10.

As shown in FIG. 2, the recording portion 24 is disposed on an upper side of the platen 42. The recording portion 24 includes a carriage 38 which is moved in the width direction 122 (i.e., the direction perpendicular to the sheet surface of FIG. 2). On the carriage 38 are mounted a recording head 39 of ink-jet recording type which will be described below and an optical sensor 70. Here, the width direction 122 is a direction perpendicular to the sheet-feed direction 17 in which the recording sheet 50 is fed.

Figure 3:
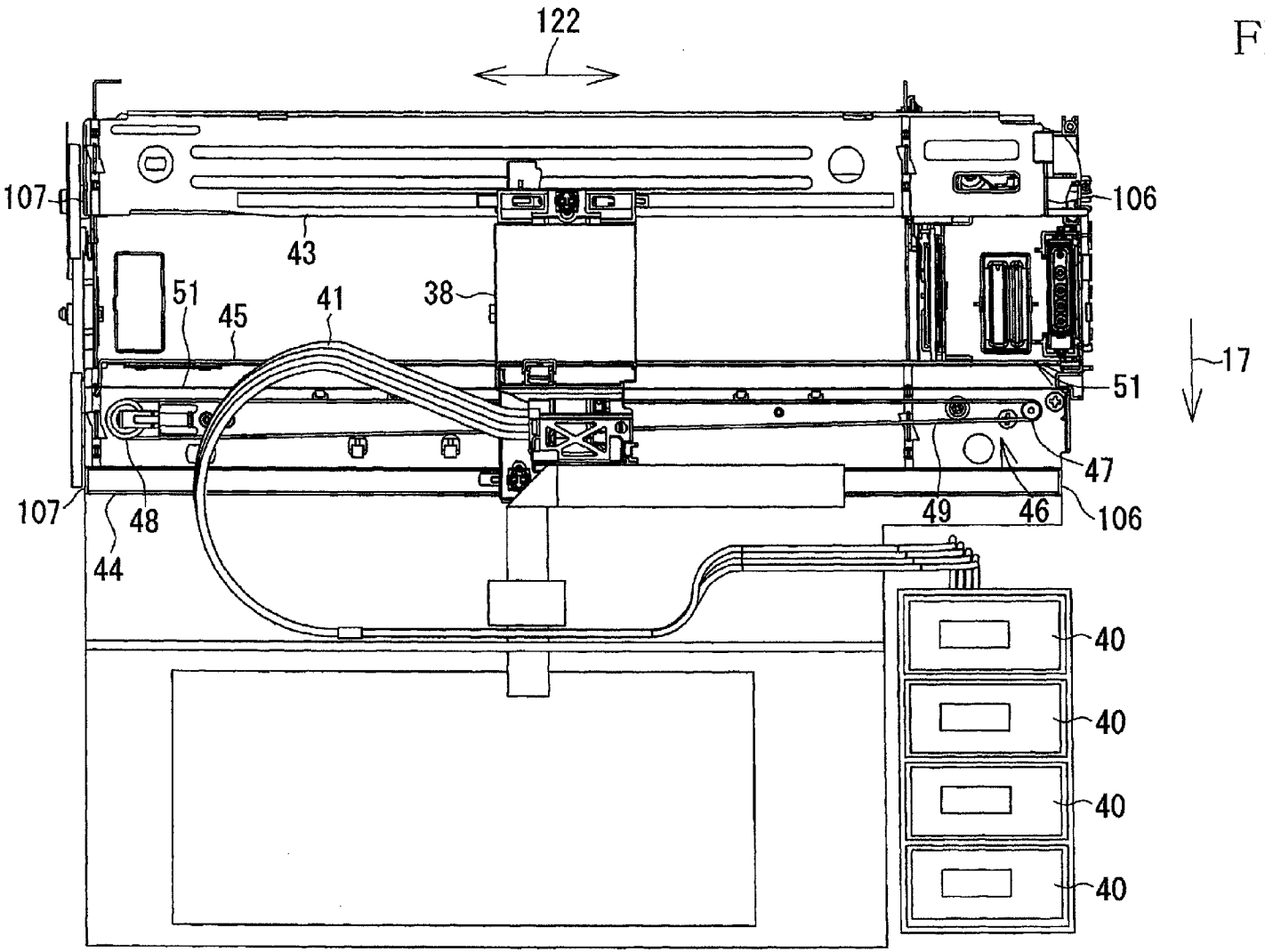
FIG. 3 is a plan view showing a main structure of the printer section 11.

As shown in FIG. 3, on an upper side of the sheet-feed path 23, a pair of guide frames 43, 44 are provided so as to be spaced from each other at a predetermined distance in the sheet-feed direction 17. The guide frames 43, 44 extend in the width direction 122. The guide frame 43 is provided on an upstream side of the guide frame 44 in the sheet-feed direction 17. The carriage 38 is mounted on the guide frames 43, 44 so as to bridge the guide frames 43, 44. As a result, as shown in FIG. 2, the carriage 38 is disposed so as to be opposed to the platen 42 with the sheet-feed path 23 interposed therebetween. It is noted that the guide frames 43, 44 are omitted in FIG. 2.

An upstream end portion of the carriage 38 in the sheet-feed direction 17 is slidably supported by an upper surface of the guide frame 43. A downstream end portion of the carriage 38 in the sheet-feed direction 17 is slidably supported by an upper surface of the guide frame 44. An end portion 45 of the guide frame 44 is bend upward at a generally right angle and extends in the width direction 122. The carriage 38 nips the end portion 45 by, e.g., rollers (not shown). As a result, the carriage 38 is movable in the width direction 122 on and along the end portion 45. It is noted that, as described below, sliding members 86 (with reference to FIGS. 6 and 7) for reducing friction are respectively provided at portions of the carriage 38 at which the carriage 38 contacts with the respective upper surfaces of the guide frames 43, 44.

A belt driving mechanism 46 is provided on the upper surface of the guide frame 44. The belt driving mechanism 46 includes a drive pulley 47, a driven pulley 48, and a drive belt 49. The drive pulley 47 and the driven pulley 48 are respectively provided near opposite ends of the upper surface of guide frame 44 in the width direction 122. The drive belt 49 is an endless annular belt having teeth formed on its inner surface, and bridged between the drive pulley 47 and the driven pulley 48.

A CR motor 84 (with reference to FIG. 8) is connected to a shaft of the drive pulley 47. The drive pulley 47 is rotated by receiving a drive force of the CR motor 84. This drive force of the drive pulley 47 causes the drive belt 49 to rotate. The carriage 38 is fixed to the drive belt 49, and thus moved in the width direction 122 by the rotation of the drive belt 49.

An encoder strip 51 is provided on the guide frame 44. The encoder strip 51 is provided so as to extend along the end portion 45. The encoder strip 51 is constituted by a belt-like sheet formed of a transparent resin. The encoder strip 51 includes light transmitting portions and light intercepting portions alternately arranged at regular pitches so as to form a predetermined pattern. On the carriage 38 is mounted a photo interrupter for detecting the pattern of the encoder strip 51.

<Recording Head 39>

Ink cartridges 40 (with reference to FIG. 3) are disposed or mounted in the printer section 11. Inks are respectively supplied from the ink cartridges 40 to the recording head 39 via the ink tubes 41. As shown in FIG. 2, the recording head 39 is mounted on the carriage 38 such that nozzles of the recording head 39 are exposed downward from a bottom surface of the carriage 38. While the carriage 38 is moved in the width direction 122, fine ink droplets are selectively ejected from the nozzles of the recording head 39 toward the platen 42. As a result, the image is recorded on the recording sheet 50 fed along the platen 42.

<Optical Sensor 70>

As described above, the optical sensor 70 (with reference to FIGS. 2 and 4) is mounted on the carriage 38 with the recording head 39. Thus, the optical sensor 70 is movable in the width direction 122. The optical sensor 70 is provided on an upstream side of the recording head 39 in the sheet-feed direction 17. However, a position at which the optical sensor 70 is provided is not limited to this position. That is, the optical sensor 70 may be provided at a position adjacent to the recording head 39 in the width direction 122 and may be provided on a downstream side of the recording head 39 in the sheet-feed direction 17.

The optical sensor 70 is of reflection type including a light emitting element 67 (e.g., an LED) and a light receiving element 68 (e.g., a photo transistor) constituted integrally with each other. The light emitting element 67 emits light with intensity S toward the platen 42. The intensity S will be described below.

Figure 4A:
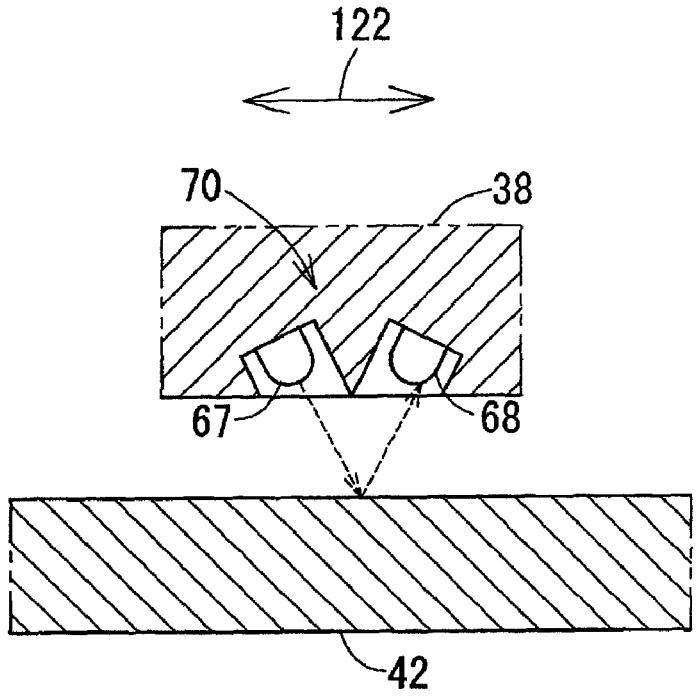
Figure 4B:
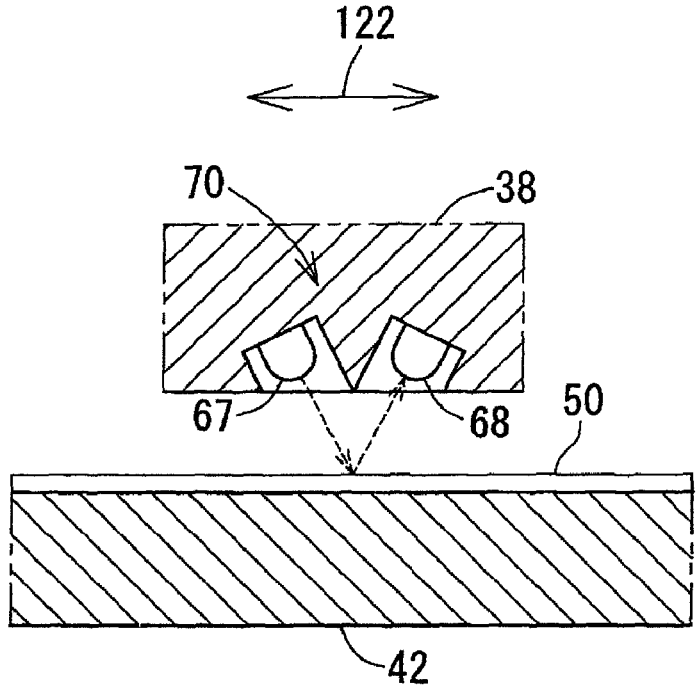
FIG. 4B is a schematic cross-sectional view of the carriage 38 and the platen 42 in a state in which the recording sheet 50 is disposed on the platen 42.

As shown in FIG. 4A, the light is emitted from the light emitting element 67 in a state in which the recording sheet 50 is not disposed on the platen 42. In this case, the light emitted from the light emitting element 67 is reflected from the surface of the platen 42, and part of the reflected light is received by the light receiving element 68. As shown in FIG. 4B, the light is emitted from the light emitting element 67 in a state in which the recording sheet 50 is disposed on the platen 42. In this case, the light emitted from the light emitting element 67 is reflected from the surface of the recording sheet 50, and part of the reflected light is received by the light receiving element 68. The light receiving element 68 produces an electric signal (an voltage signal in the present embodiment) in accordance with intensity of the reflected light received by the light receiving element 68. The voltage signal produced by the light receiving element 68 is outputted to the controller 100 (with reference to FIG. 8).

<Changing Mechanism 130>

Figure 6:
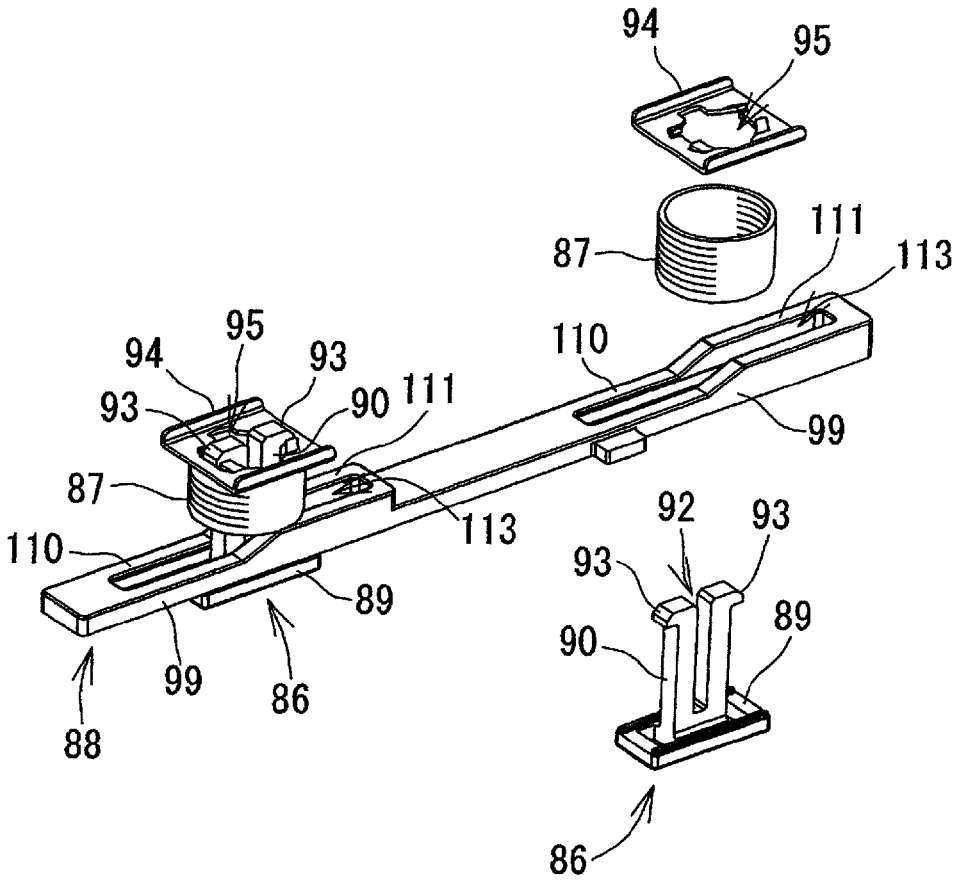
FIG. 6 is an exploded perspective view showing structures of sliding members 86, coil springs 87, and a gap adjusting member 88.

A changing mechanism 130 (with reference to FIG. 7) is configured to move the carriage 38 upward and downward relative to the platen 42 in the height direction 121. In the present embodiment, this changing mechanism 130 includes the belt driving mechanism 46, the sliding members 86, coil springs 87, gap adjusting members 88, contact members 106, 107, and the CR motor 84. It is noted that, as shown in FIG. 6, the sliding members 86, the coil springs 87, and the gap adjusting members 88 are mounted on an upstream portion and a downstream portion of a carriage main body 85 in the sheet-feed direction 17 in correspondence with the guide frames 43, 44, but these have generally the same construction. Thus, there will be hereinafter explained a downstream construction in the sheet-feed direction 17 as an example.

As shown in FIG. 6, the gap adjusting member 88 includes the two sliding members 86 so as to be disposed in the width direction 122. Each sliding member 86 includes a slidably contacting plate 89 and a pair of leg portions 90. The slidably contacting plate 89 is a rectangular planar plate whose length in a direction perpendicular to a longitudinal direction thereof is generally the same as a length of the gap adjusting member 88 in a direction perpendicular to a longitudinal direction thereof. A lower surface of the slidably contacting plate 89 contacts with the guide frames 43, 44. The two leg portions 90 are provided on an upper surface of the slidably contacting plate 89 so as to extend in a direction generally perpendicular to the upper surface of the slidably contacting plate 89. Further, the two leg portions 90 are disposed so as to be opposed to and spaced from each other at a predetermined distance in a longitudinal direction of the slidably contacting plate 89. As a result, a guide groove 92 is formed between the two leg portions 90. At respective distal ends of the leg portions 90, there are formed engaging portions 93 projecting outward in the longitudinal direction of the slidably contacting plate 89. The engaging portions 93 are for engaging or fastening the slidably contacting plate 89 with or to a fastening plate 94.

Through the fastening plate 94 is formed a through hole 95 through which the leg portions 90 are inserted. An inside diameter of the through hole 95 is set smaller than a distance between projected ends of the respective engaging portions 93. Thus, the pair of leg portions 90 can be inserted through the through hole 95 by being elastically deformed such that the engaging portions 93 are moved nearer to each other. The elastically deformed leg portions 90 return to their original shape, whereby the engaging portions 93 are engaged with or fastened to the fastening plate 94.

As shown in FIG. 7, the carriage main body 85 is provided with a support member 96 supporting the sliding members 86 such that the carriage main body 85 is movable upward and downward relative to the sliding members 86. In the support member 96 is formed two recessed portions each having an inside diameter slightly larger than an outside diameter of each coil spring 87 such that each recessed portion is dented or bent downward. Through holes 97 and support ribs 98 are formed in respective bottom surfaces of the recessed portions. The pair of the leg portions 90 of each sliding member 86 are inserted into a corresponding one of the through holes 97 while each of the support ribs 98 is inserted into a corresponding one of the guide groove 92 of the sliding member 86. As a result, the support member 96 is supported by the sliding members 86 so as to be movable upward and downward along the guide grooves 92.

Figure 7A:
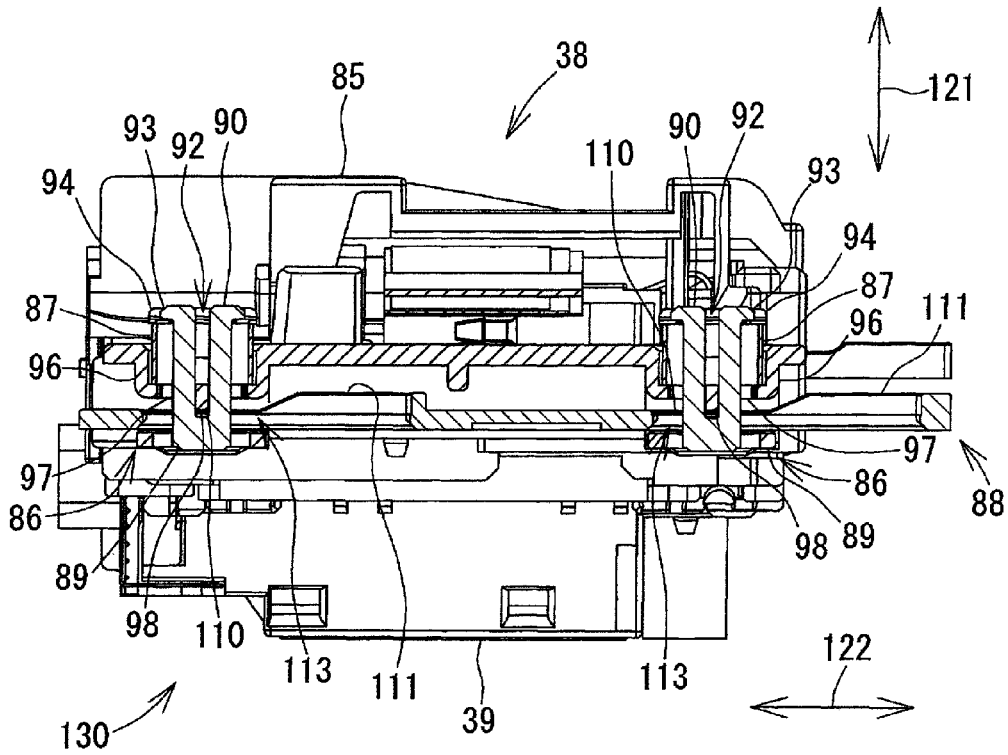
Figure 7B:
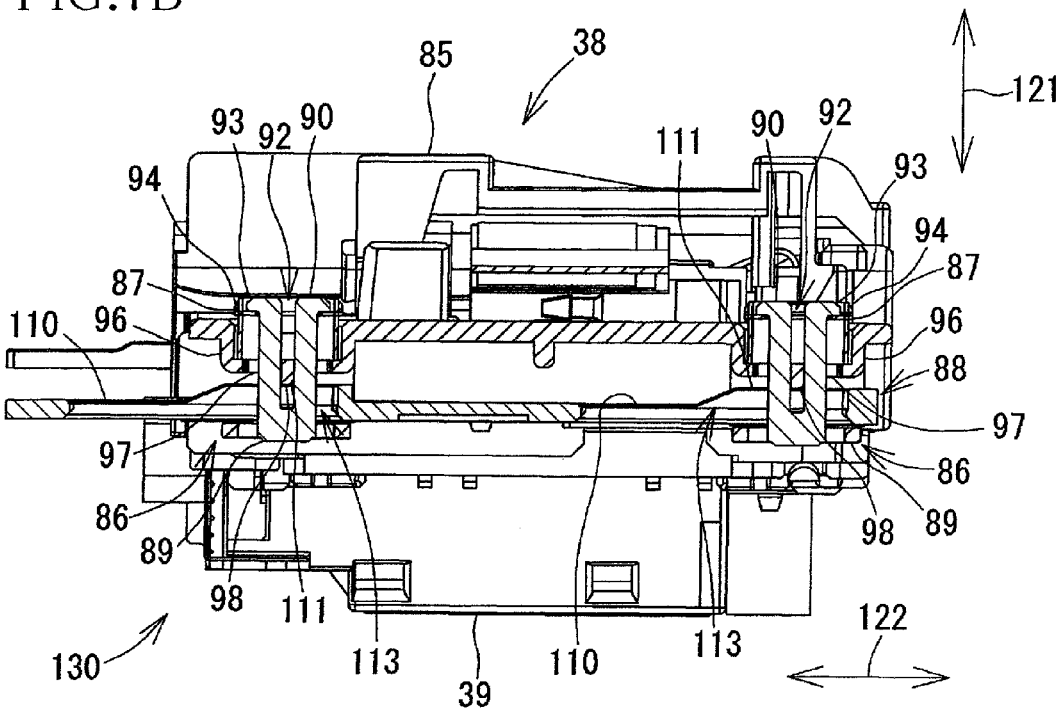
FIG. 7B is a cross-sectional view taken along line VII-VII in FIG. 5 in a state in which the gap adjusting member 88 is held in contact with contact members 106.

As shown in FIGS. 7A and 7B, the gap adjusting member 88 is disposed between the support ribs 98 of the support member 96 and the slidably contacting plates 89 of the respective sliding members 86. As shown in FIG. 6, the gap adjusting member 88 is a planar plate having a generally elongated rod-like shape and has a pair of adjusting portions 99 formed so as to be spaced from each other in a longitudinal direction thereof. Each of the adjusting portions 99 has a thickness of two different levels changed in a longitudinal direction of the gap adjusting member 88. That is, each adjusting portion 99 has a thin part 110 and a thick part 111 which is thicker than the thin part 110. The thin part 110 and the thick part 111 are formed adjacent to each other such that the thickness of each adjusting portion is changed in one direction (i.e., in a right and left direction in FIG. 7 or in the direction in which the carriage 38 is moved).

In each adjusting portion 99 is formed an elongate hole 113 extending through the thickness of the thin part 110 and the thick part 111 (i.e., in an upward and downward direction in FIG. 7). As shown in FIG. 6, the leg portions 90 are inserted through the elongate hole 113. Each pair of the leg portions 90 are inserted through of the corresponding elongate hole 113 of the gap adjusting member 88, then through the through hole 97 of the corresponding support member 96, and further through the through hole 95 of the corresponding fastening plate 94. As a result, the support rib 98 of each support member 96 is disposed in the corresponding guide groove 92.

The coil springs 87 are disposed respectively between the fastening plates 94 and the respective bottom surface of the recessed portions of the support member 96 in a state in which the coil springs 87 are compressed. The fastening plates 94 are biased upward by elastic forces of the respective coil springs 87. These elastic forces are respectively applied to the sliding members 86 via the fastening plates 94. As a result, each of the sliding members 86 is elastically biased so as to be located at an uppermost position in a range in which the corresponding support rib 98 permits the sliding member 86 to be moved upward and downward. It is noted that since the gap adjusting member 88 is disposed between the support ribs 98 and the respective slidably contacting plates 89 of the sliding members 86, the carriage 38 is moved upward relative to the sliding members 86 by the thicknesses of the respective adjusting portions 99 of the gap adjusting member 88 against biasing forces.

Figure 5:
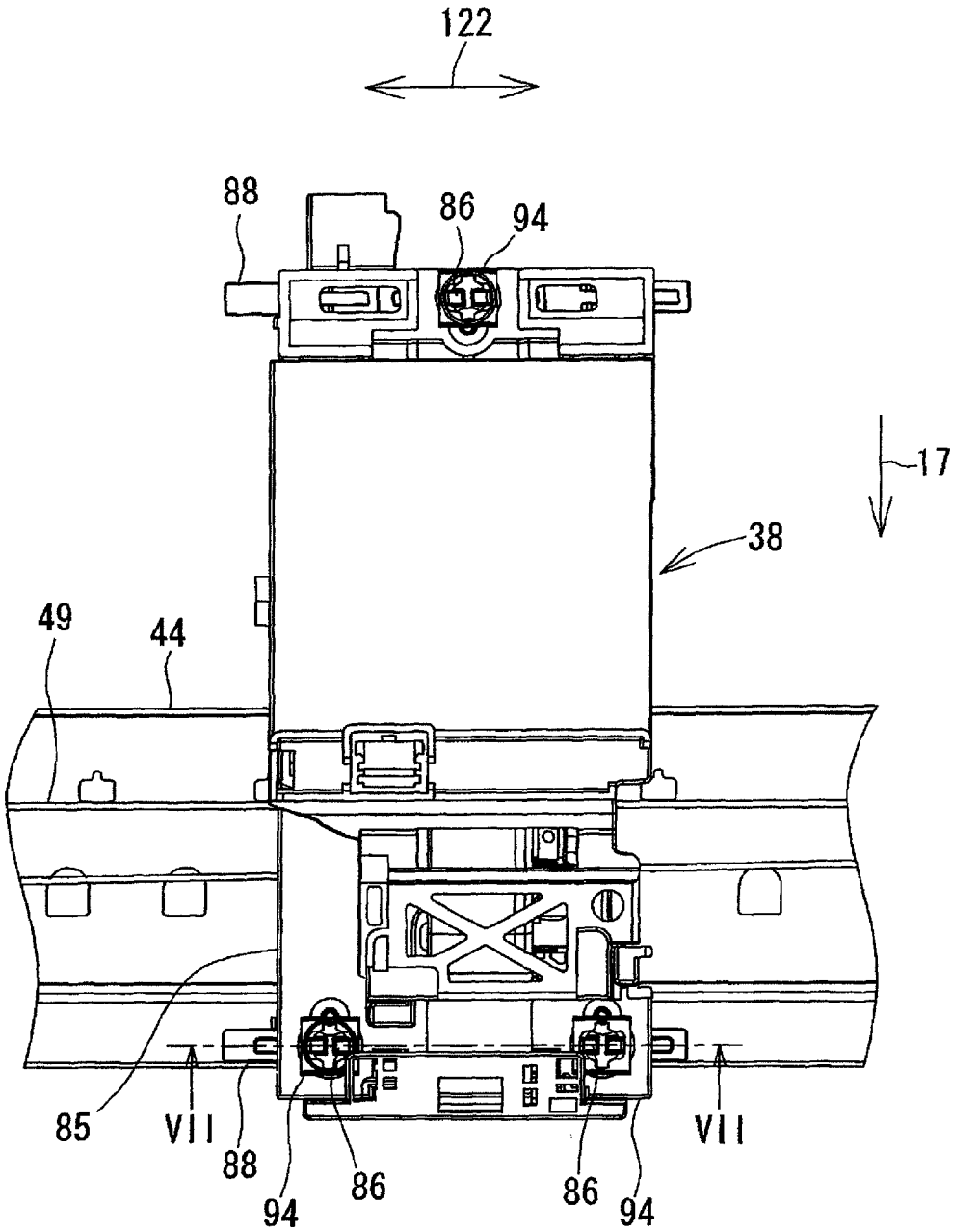
FIG. 5 is an enlarged plan view showing an external structure of the carriage 38.

Since the leg portions 90 of each sliding member 86 are inserted through the corresponding elongate hole 113 of the gap adjusting member 88, the gap adjusting member 88 is slidable relative to the sliding member 86 in the width direction 122 (in the direction in which the carriage 38 is moved). As shown in FIG. 3, opposite ends of each of the guide frames 43, 44 in the width direction 122 are bent upward so as to provide the contact members 106, 107. As shown in FIG. 5, the gap adjusting member 88 has such a length that opposite ends thereof in its sliding direction (i.e., the width direction 122) are projected from the carriage main body 85. In other words, the gap adjusting member 88 has a projecting or extending portion projecting outward from the carriage main body 85 in the width direction 122.

When the carriage 38 is moved in the width direction 122, the gap adjusting member 88 is brought into contact with the contact members 106 or the contact members 107. As a result, the gap adjusting member 88 is moved relative to the sliding members 86, so that each thin part 110 or each thick part 111 is disposed between the corresponding slidably contacting plate 89 and the corresponding support rib 98. That is, the thickness of each adjusting portion 99 located between the corresponding slidably contacting plate 89 and the corresponding support rib 98 is changed. This change of the thickness changes a height of the support rib 98, i.e., a position of the carriage 38 in the height direction 121. As thus described, the gap adjusting member 88 is brought into contact with the contact members 106 or the contact members 107, whereby the carriage 38 is moved relative to the platen 42 toward and away from the platen 42 (i.e., in the height direction 121).

<Controller 100>

Figure 8:
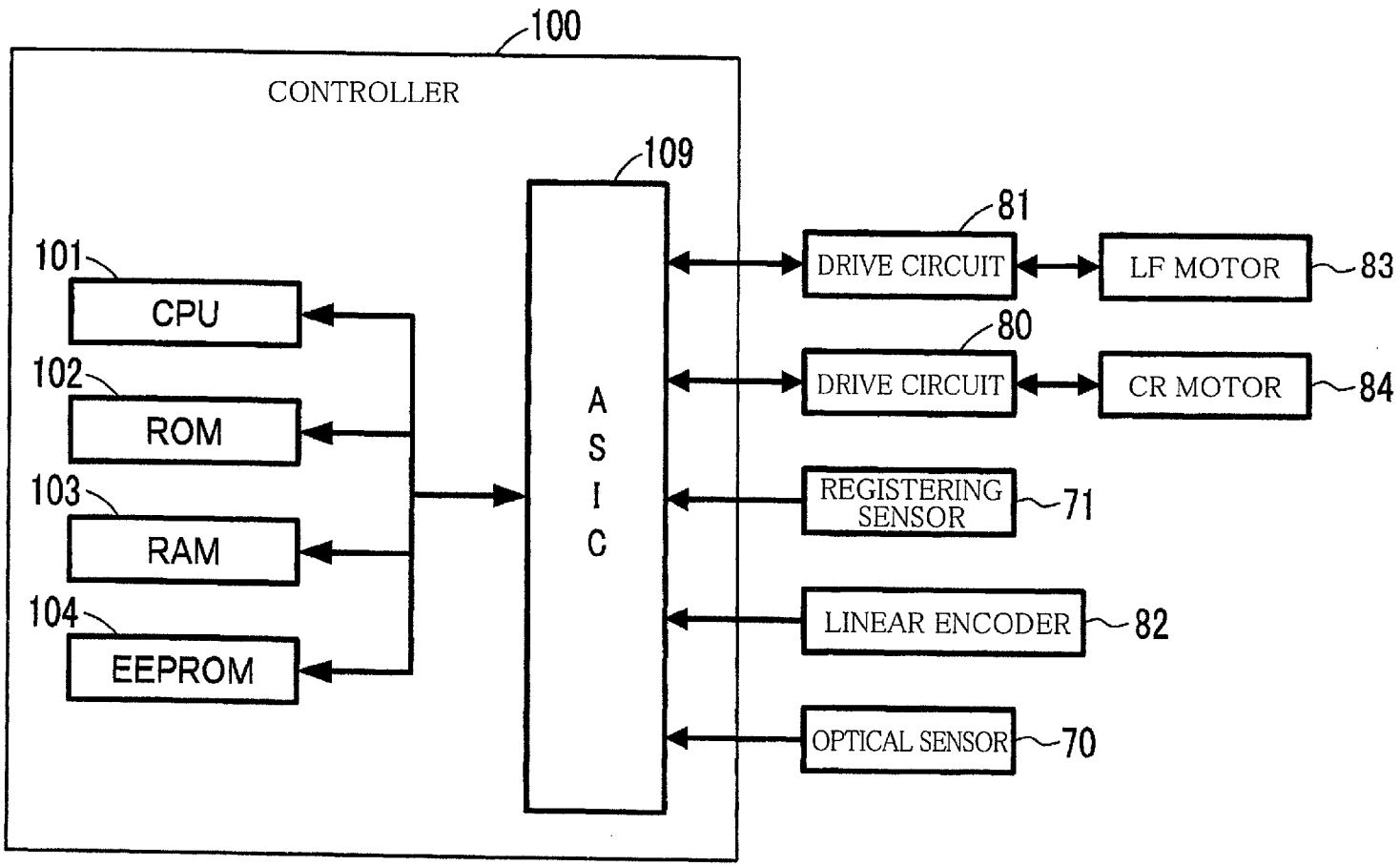
FIG. 8 is a block diagram showing an example of a configuration of a controller 100.

The controller 100 (with reference to FIG. 8) generally controls not only the printer section 11 but also operations of the MFD 10 as a whole. As shown in FIG. 8, the controller 100 is constituted by a microcomputer mainly including a CPU 101, a ROM 102, a RAM 103, an EEPROM 104, and an Application Specific Integrated Circuit (ASIC) 109. The controller 100 controls components or devices of the MFD 10 for driving the LF motor 83, the CR motor 84, the printer section 11, and the scanner section 12.

The ROM 102 stores programs and so on for controlling components such as the motors 83, 84 and the MFD 10 by the CPU 101. The ROM 102 stores a table for changing the height position of the carriage 38. The table is a table representative of a relationship between (a) a thickness of the recording sheet 50 and a resolution of the image recorded on the recording sheet 50, and (b) the height position of the carriage 38 (i.e., a first position and a second position which will be described below). The controller 100 changes the height position of the carriage 38 by the changing mechanism 130 on the basis of the table stored in the ROM 102 and the information received from the external information device.

The ROM 102 stores a distance (a reference distance) $d_0$ from an upper surface of the platen 42 to an upper surface of a test paper (a reference sheet) described below (i.e., a thickness of the test paper), a light reflectivity $R_0$ of a surface of the test paper, a gap change Δh (a difference between distances $h_1$ and $h_2$), the intensity S, the distances $h_1$, $h_2$ (with reference to FIG. 9), a first threshold value (a predetermined value), a second threshold value, equation (1), and equation (2) which will be described below. Equation (1) is an equation for obtaining a distance G between the optical sensor 70 and the surface of the recording sheet 50 on the platen 42. Equation (2) is an equation for obtaining a light reflectivity R of the surface of the recording sheet 50. Equation (1) and equation (2) are described below in detail.

$$G = h_1 - d_0 - \frac{\Delta h}{2}\left(1 - \frac{V_1 - V_2}{V_1 + V_2} \times \frac{V_{01} + V_{02}}{V_{01} - V_{02}}\right) \quad (1)$$

$$R = \frac{V_1 + V_2}{V_{01} + V_{02}} R_0 \quad (2)$$

The RAM 103 is used as a storing area for temporarily storing various data used when the CPU 101 executes the programs, and used as a working area for data processings and so on. The EEPROM 104 stores settings, flags, and so on which are to be kept also after the MFD 10 is turned off. This EEPROM 104 stores a voltage value $V_{01}$ (a signal level) of a first reference voltage (a first reference signal) and a voltage value $V_{02}$ (a signal level) of a second reference voltage (a second reference signal). That is, in the present embodiment, the EEPROM 104 functions as a storing section of the MFD 10.

To the ASIC 109 are connected a drive circuit 81, a drive circuit 80, the registering sensor 71, a linear encoder 82, and the optical sensor 70. It is noted that, though not shown in FIG. 8, a head controlling circuit for controlling the recording head 39, the scanner section 12, the operational panel 14, and so on are also connected to the ASIC 109.

The drive circuit 81 is for driving the LF motor 83. The sheet-supply roller 25, the sheet-feed roller 60, and the sheet-discharge roller 62 shown in FIG. 2 are connected to the LF motor 83. The drive circuit 81 receives an output signal from the ASIC 109 to drive the LF motor 83. A drive force of the LF motor 83 is selectively transmitted to the sheet-supply roller 25, the sheet-feed roller 60, and the sheet-discharge roller 62 via a well-known drive transmitting mechanism including gears, drive shafts, and so on.

The drive circuit 80 energizes a drive signal to the CR motor 84 on the basis of a phase excitation signal and the like inputted from the ASIC 109. The CR motor 84 is rotated by receiving the drive signal, whereby the carriage 38 is moved in the width direction 122.

The linear encoder 82 is for detecting the encoder strip 51 by the photo interrupter mounted on the carriage 38. The controller 100 controls the driving of the CR motor 84 on the basis of a detection signal of the linear encoder 82.

The controller 100 judges a presence or absence of the recording sheet 50 at the position P1 of the sheet-feed path 23 on the basis of a change of an electric signal outputted from the registering sensor 71.

The controller 100 detects an end portion of the recording sheet 50 in the width direction 122 on the basis of a voltage signal outputted from the optical sensor 70. Further, the controller 100 calculates, as a calculation section, the reflectivity R of the surface of the recording sheet 50 on the platen 42 on the basis of the voltage signal outputted from the optical sensor 70. Furthermore, the controller 100 calculates, as the calculation section, the distance G (with reference to FIG. 9A) between the optical sensor 70 and the recording sheet 50 on the platen 42 on the basis of the voltage signal outputted from the optical sensor 70. A processing for detecting the end portion of the recording sheet 50, a processing for calculating the reflectivity R of the surface of the recording sheet 50, and a processing for calculating the distance G will be described later.

<First Position and Second Position>

Figure 9B:
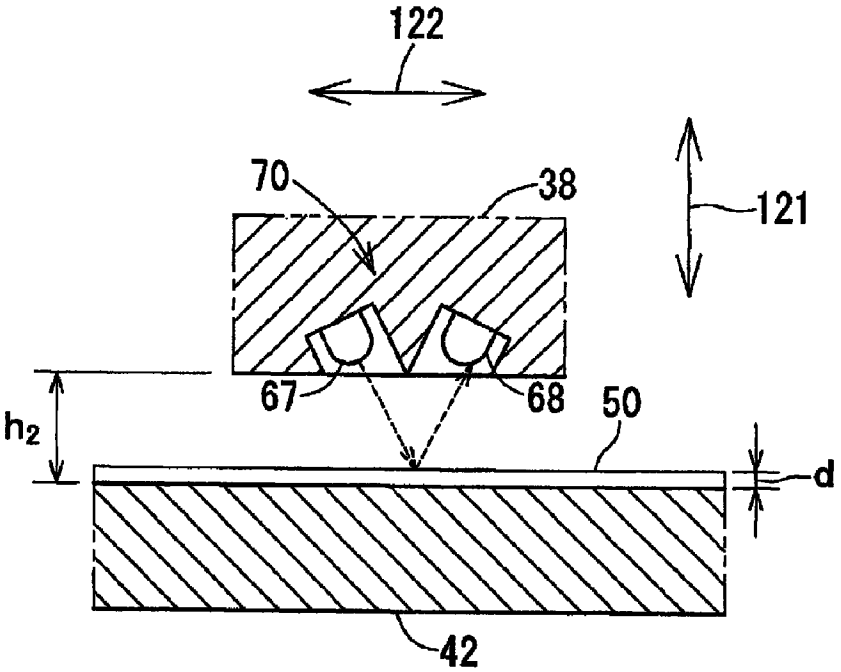
FIG. 9B is a schematic cross-sectional view of the carriage 38 and the platen 42 in a state in which the optical sensor 70 is disposed at a second position.
Figure 9A:
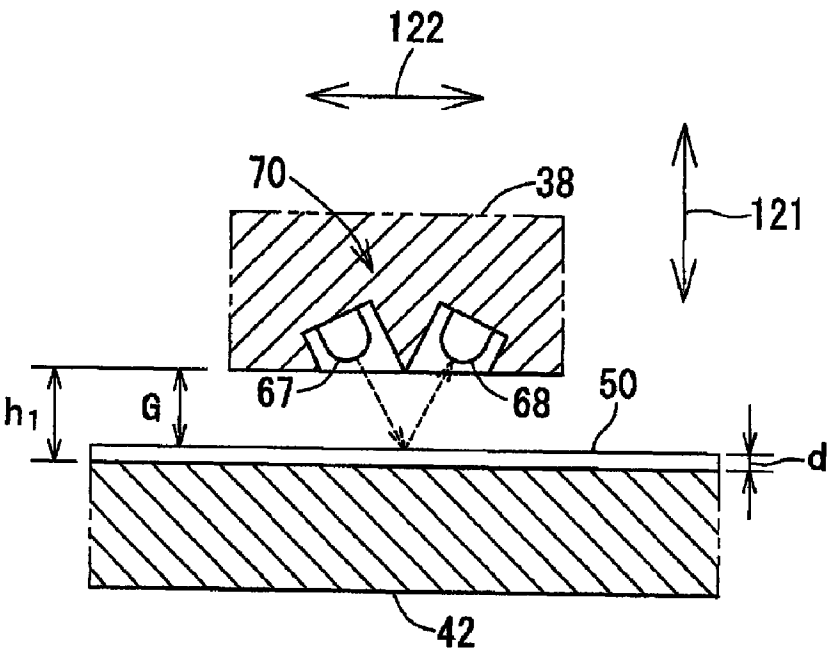

The controller 100 controls the driving of the CR motor 84 to move the carriage 38 in the width direction 122. When the carriage 38 is moved in one direction (i.e., in a leftward direction in FIG. 3) in the width direction 122, the gap adjusting member 88 is brought into contact with the contact member 107. As a result, the gap adjusting member 88 is moved in the other direction in the width direction 122 relative to the sliding members 86, so that, as shown in FIG. 7A, each thin part 110 of the gap adjusting member 88 is disposed between the corresponding slidably contacting plate 89 and the corresponding support rib 98. As a result, as shown in FIG. 9A, the optical sensor 70 is disposed at the first position distant from the platen 42 by the first distance $h_1$. In other words, the changing mechanism 130 causes the optical sensor 70 to be positioned at the first position.

When the carriage 38 is moved in the other direction (i.e., in a rightward direction in FIG. 3) in the width direction 122, the gap adjusting member 88 is brought into contact with the contact member 106. As a result, the gap adjusting member 88 is moved in the one direction in the width direction 122 relative to the sliding members 86, so that, as shown in FIG. 7B, each thick part 111 of the gap adjusting member 88 is disposed between the corresponding slidably contacting plate 89 and the corresponding support rib 98. As a result, as shown in FIG. 9B, the optical sensor 70 is disposed at the second position distant from the platen 42 by the second distance $h_2$. In other words, the changing mechanism 130 causes the optical sensor 70 to be positioned at the second position.

As thus described, the controller 100 moves the carriage 38 in the height direction 121 relative to the platen 42, whereby the optical sensor 70 is disposed at the first position or the second position. The optical sensor 70 is moved from the first position to the second position, or the optical sensor 70 is moved from the second position to the first position. In other words, the controller 100 controls the changing mechanism 130 to change a position of the optical sensor 70 between the first position and the second position by moving the carriage 38 relative to the platen 42 in the height direction 121. More specifically, the controller 100 controls the changing mechanism 130 to change the position of the optical sensor 70 between the first position and the second position by moving the carriage 38 in the width direction 122 so as to move the carriage 38 in the height direction 121. As a result, a distance between the optical sensor 70 and the platen 42 is changed by the Δh. This gap change Δh is a known value determined by a difference between the second distance $h_2$ and the first distance $h_1$, and stored in the ROM 102 with the first distance $h_1$ and the second distance $h_2$. It is noted that, the first distance $h_1$ is changeable by changing the thickness of the thin parts 110 of the gap adjusting member 88. Further, the second distance $h_2$ is changeable by changing the thickness of the thick parts 111 of the gap adjusting member 88.

The controller 100 changes the height position of the carriage 38 to the two levels on the basis of the information transmitted from the external information device, for example. This information includes information such as information indicating the thickness of the recording sheet 50 and information indicating the resolution of the image to be recorded on the recording sheet 50. For example, where the recording sheet 50 is a thick sheet, the controller 100 increases the height of the carriage 38 in order to move the recording head 39 away from the platen 42. That is, the controller 100 controls the carriage 38 to be disposed at the second position. This prevents the recording sheet 50 from contacting with the recording head 39. Further, the resolution of the image recorded on the recording sheet 50 is a high resolution, each ink droplet ejected from the recording head 39 is small when compared with a case in which the resolution is a low resolution. Thus, the controller 100 decreases the height of the carriage 38 in order to move the recording head 39 toward or nearer to the platen 42. That is, the controller 100 controls the carriage 38 to be disposed at the first position. As a result, the ink is attached to the recording sheet 50 more accurately. In other words, a positional accuracy of the ink attached to the recording sheet 50 is improved.

As thus described, the printer section 11 includes the changing mechanism 130 for preventing the recording sheet 50 from contacting with the recording head 39 and for improving the positional accuracy of the ink attached to the recording sheet 50.

<First Reference Voltage $V_{01}$ and Second Reference Voltage $V_{02}$>

The respective voltage values $V_{01}$, $V_{02}$ (the signal levels) of the first reference voltage and the second reference voltage are obtained in advance before shipments of the MFD 10 from factories, and stored in the EEPROM 104. Hereinafter, this operation may also be referred to as a calibration. The first reference voltage $V_{01}$ and the second reference voltage $V_{02}$ are obtained in the following manner.

In the calibration, the CR motor 84 is initially driven to move the carriage 38 to cause the optical sensor 70 to be disposed at the first position. Then, the test paper having the reflectivity $R_0$ is placed on the platen 42 such that the distance from the upper surface of the platen 42 to the upper surface of the test paper (not shown) becomes $d_0$. Specifically, for example, a sheet having a thickness $d_0$ is closely contacted with the platen 42. In this state, the light with the intensity S is emitted from the light emitting element 67 of the optical sensor 70. The light emitted from the light emitting element 67 is reflected from the surface of the test paper and received by the light receiving element 68. The light receiving element 68 outputs the first reference voltage based on an intensity of this reflected light.

Next, the CR motor 84 is driven to move the carriage 38 to cause the optical sensor 70 to be disposed at the second position. The above-mentioned test paper is placed on the platen 42. In this state, the light with the intensity S is reemitted from the light emitting element 67 of the optical sensor 70. The light emitted from the light emitting element 67 is reflected from the surface of the test paper and received by the light receiving element 68. The light receiving element 68 outputs the second reference voltage based on an intensity of the reflected light. The voltage value $V_{01}$ of the first reference voltage and the voltage value $V_{02}$ of the second reference voltage thus obtained are stored in the EEPROM 104.

<Equation (1), Equation (2)>

Equation (1) and equation (2) are derived in the following manner.

Where a distance between the optical sensor 70 and the recording sheet 50 on the platen 42 is constant, and a light-emission intensity of the light emitting element 67 is constant at the intensity S, the intensity of the light received by the light receiving element 68 is proportional to the reflectivity of the surface of the recording sheet 50. Where a sensor whose output is linear is used as the optical sensor 70, the voltage value of the voltage signal outputted from the light receiving element 68 is generally proportional to the reflectivity of the surface of the recording sheet 50. Thus, where the optical sensor 70 is disposed at the first position, and the recording sheet 50 having the reflectivity R is placed on the platen 42, a voltage value $V_{01}'$ of a voltage signal outputted from the light receiving element 68 of the optical sensor 70 is expressed by the following equation (3). Further, where the optical sensor 70 is disposed at the second position, and the recording sheet 50 having the reflectivity R is placed on the platen 42, a voltage value $V_{02}'$ of a voltage signal outputted from the light receiving element 68 of the optical sensor 70 is expressed by the following equation (4). It is noted that where a sensor whose output is non-linear is used as the optical sensor 70, the output can be converted to be linear in a well-known method by using a characteristic curve. Thus, a value of an electric signal obtained by converting the voltage value of the voltage signal outputted from the light receiving element 68 is generally proportional to the reflectivity of the surface of the recording sheet 50.

$$V_{01}' = \frac{R}{R_0} V_{01} \tag{3}$$

$$V_{02}' = \frac{R}{R_0} V_{02} \tag{4}$$

Figure 10:
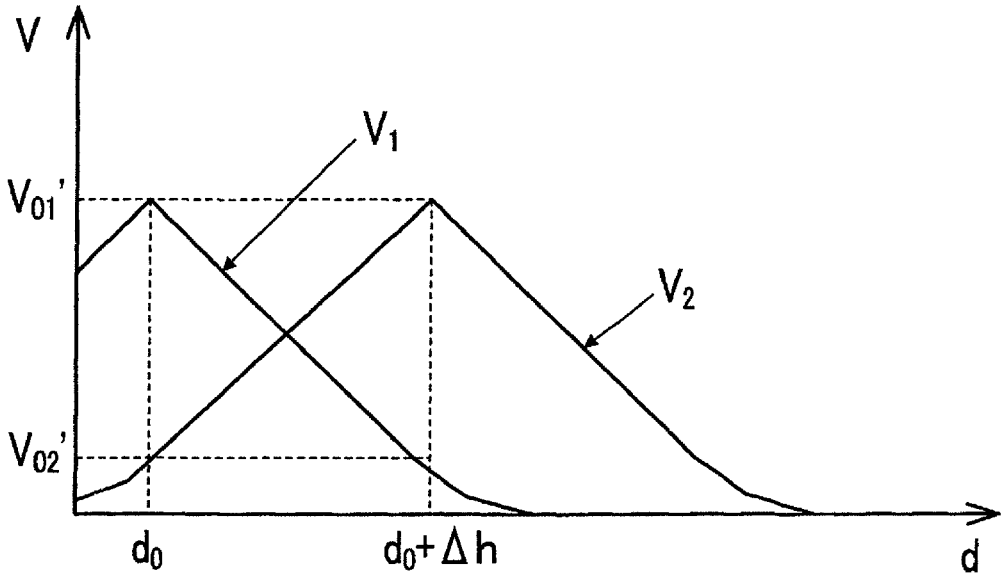
FIG. 10 is a view showing changes of a voltage value $V_1$ and a voltage value $V_2$ with respect to a distance d from an upper surface of the platen 42 to an upper surface of the recording sheet 50.

FIG. 10 shows the voltage value $V_{01}'$ and the voltage value $V_{02}'$. In FIG. 10, where a curve indicating an output voltage within a range of $d_0 \leqq d \leqq d_0 + \Delta h$ is considered to be a straight line, a voltage value $V_1$ of a first voltage signal (a first electric signal) outputted from the light receiving element 68 in the state in which the optical sensor 70 is disposed at the first position is expressed by the following equation (5). Further, a voltage value $V_2$ of a second voltage signal (a second electric signal) outputted from the light receiving element 68 in the state in which the optical sensor 70 is disposed at the second position is expressed by the following equation (6). It is noted that d in the following equation is a distance from the upper surface of the platen 42 to the upper surface of the recording sheet 50, and each of equation (5) and equation (6) is a relational equation which holds within the range of $d_0 \leqq d \leqq d_0 + \Delta h$.

$$V_1 = -\frac{V_{01}' - V_{02}'}{\Delta h}(d - d_0) + V_{01}' \tag{5}$$

$$V_2 = \frac{V_{01}' - V_{02}'}{\Delta h}(d - d_0) + V_{02}' \tag{6}$$

$V_{01}'$ in each of equation (5) and equation (6) is expressed by equation (3), and $V_{02}'$ is expressed by equation (4). Thus, equation (5) can be modified to the following equation (7) by respectively substituting $V_{01}'$ in equation (3) and $V_{02}'$ in equation (4) into $V_{01}'$ and $V_{02}'$ in equation (5). Further, equation (6) can be modified to the following equation (8) by respectively substituting $V_{01}'$ in equation (3) and $V_{02}'$ in equation (4) into $V_{01}'$ and $V_{02}'$ in equation (6).

$$V_1 = \left\{-\frac{V_{01} - V_{02}}{\Delta h}(d - d_0) + V_{01}\right\}\frac{R}{R_0} \tag{7}$$

$$V_2 = \left\{\frac{V_{01} - V_{02}}{\Delta h}(d - d_0) + V_{02}\right\}\frac{R}{R_0} \tag{8}$$

The following equation (9) can be obtained by adding both sides of equation (7) and corresponding sides of equation (8).

$$V_1 + V_2 = (V_{01} + V_{02})\frac{R}{R_0} \tag{9}$$

Further, the following equation (10) can be obtained by subtracting both sides of equation (8) from corresponding sides of equation (7).

$$V_1 - V_2 = \left\{-2\frac{V_{01} - V_{02}}{\Delta h}(d - d_0) + V_{01} - V_{02}\right\}\frac{R}{R_0} \tag{10}$$

The following equation (11) can be obtained by solving simultaneous equations composed of equation (9) and equation (10) for eliminating R and $R_0$.

$$\frac{V_1 - V_2}{V_1 + V_2} = \frac{V_{01} - V_{02}}{V_{01} + V_{02}}\left(1 - 2\frac{d - d_0}{\Delta h}\right) \tag{11}$$

Equation (12) is obtained by modifying equation (11) to an equation expressing the distance d from the upper surface of the platen 42 to the upper surface of the recording sheet 50. Where the optical sensor 70 is disposed at the first position (with reference to FIG. 9A), the distance from the optical sensor 70 to the upper surface of the platen 42 is the first distance $h_1$. Thus, the distance G between the optical sensor 70 and the surface of the recording sheet 50 on the platen 42 is expressed by the following equation (13).

$$d = d_0 + \frac{\Delta h}{2}\left(1 - \frac{V_1 - V_2}{V_1 + V_2} \times \frac{V_{01} + V_{02}}{V_{01} - V_{02}}\right) \tag{12}$$

$$G = h_1 - d \tag{13}$$

Equation (1) is derived by substituting d in equation (12) into d in equation (13). It is noted that equation (2) is obtained by modifying equation (9) to an equation expressing the reflectivity R of the surface of the recording sheet 50.

<Detection of End Portion of Recording Sheet 50>

Figure 11:
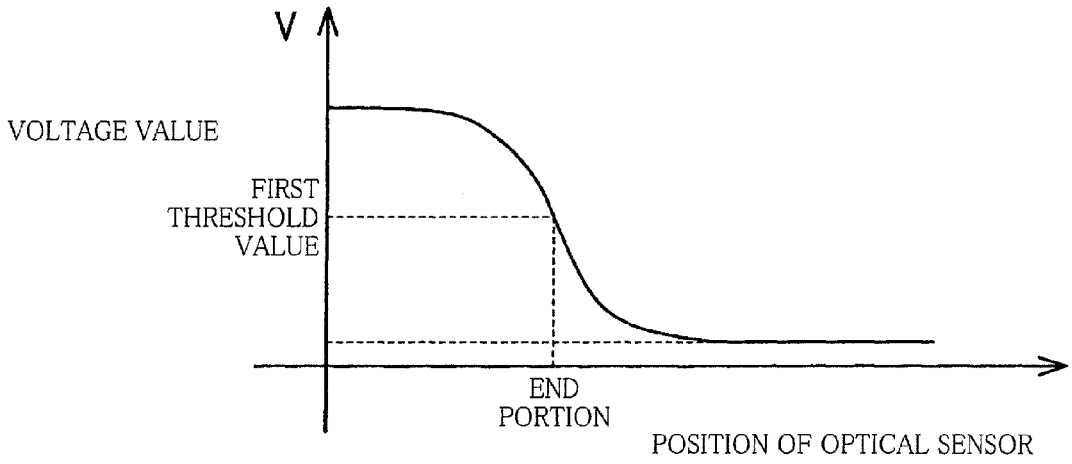
FIG. 11 is a view showing a change of a voltage value of a voltage signal outputted from a light receiving element 68 in a process in which the carriage 38 is moved in a width direction 122.

In the printer section 11, the end portion of the recording sheet 50 in the width direction 122 is detected in the following manner. As described above, the reflectivity of the surface of the platen 42 is smaller than the reflectivity R of the surface of the recording sheet 50. Thus, when the light emitted from the light emitting element 67 has been irradiated to a vicinity of the end portion of the recording sheet 50 in a process in which the carriage 38 is moved in the width direction 122, the voltage value of the voltage signal outputted from the light receiving element 68 is greatly changed. Specifically, as shown in FIG. 11, when a state in which the light emitted from the light emitting element 67 is reflected from the surface of the recording sheet 50 is changed or shifted to a state in which the light is reflected from the surface of the platen 42, the voltage value of the voltage signal outputted from the light receiving element 68 is greatly decreased. The controller 100 detects, as the end portion of the recording sheet 50 in the width direction 122, the position of the optical sensor 70 when the voltage value of the voltage signal outputted from the light receiving element 68 becomes the first threshold value stored in the ROM 102. That is, the controller 100 functions as a detecting section. It is noted that the first threshold value is set to an appropriate value such that the controller can accurately judge the end portion of the recording sheet 50 and the surface of the platen 42.

It is noted that the reflectivity of the surface of the recording sheet 50 is different in between a case in which the recording sheet 50 is the normal sheet and a case in which the recording sheet 50 is the glossy sheet. Thus, the first threshold value may be changed according to the types of the recording sheet 50 as needed. That is, the end portion of the recording sheet 50 may be detected using the first threshold values which are different in between the case in which the recording sheet 50 is the normal sheet and the case in which the recording sheet 50 is the glossy sheet.

<Calculation Method>

Hereinafter, there will be explained a method for calculating the distance G between the optical sensor 70 and the surface of the recording sheet 50, or light reflectivity R of the surface of the recording sheet 50.

In a first step, the controller 100 controls the driving of the LF motor 83 to rotate the sheet-supply roller 25. As a result, the recording sheet 50 is supplied from the sheet-supply tray 20 to the sheet-feed path 23. The controller 100 judges whether a leading end of the recording sheet 50 has reached the position P1 or not on the basis of the electric signal outputted from the registering sensor 71. Where the controller 100 has judged that the leading end of the recording sheet 50 has reached the position P1, the drive force of the LF motor 83 is transmitted to the sheet-feed roller 60 and the sheet-discharge roller 62. As a result, the recording sheet 50 is fed onto the platen 42 by receiving the rotational force of the sheet-feed roller 60.

When the optical sensor 70 has detected the leading end of the recording sheet 50, the controller 100 stops the LF motor 83. Then, the controller 100 controls the optical sensor 70 to be disposed at the first position. Specifically, the controller 100 controls the driving of the CR motor 84 to move the carriage 38 in the width direction 122, so as to bring the gap adjusting member 88 into contact with the contact member 107 (with reference to FIG. 3). As a result, as shown in FIG. 9A, the optical sensor 70 is distant from the platen 42 by the first distance $h_1$. The controller 100 controls the carriage 38 to move in the width direction 122 to a generally central position of the guide frames 43, 44 in the width direction 122 such that the gap adjusting member 88 is not brought into contact with the contact member 106. As a result, the optical sensor 70 is disposed on an upper side of the recording sheet 50 in the state in which the optical sensor 70 is disposed at the first position. It is noted that, where the optical sensor 70 has already been disposed at the first position, there is no need to bring the gap adjusting member 88 into contact with the contact member 107. That is, the first step is unnecessary.

In a second step, the controller 100 controls the light emitting element 67 to emit the light with the intensity S in the state in which the optical sensor 70 is disposed at the first position. That is, the controller 100 controls the light emitting element 67 to emit the light with intensity the same as at the calibration. This light is reflected from the surface of the recording sheet 50 and received by the light receiving element 68. The light receiving element 68 outputs to the controller 100 the first voltage signal according to the intensity of the received light. The controller 100 temporarily stores the voltage value $V_1$ of the thus obtained first voltage signal into the RAM 103.

In a third step, the optical sensor 70 is moved from the first position to the second position. The controller 100 controls the driving of the CR motor 84 to move the carriage 38 in the width direction 122, so as to bring the gap adjusting member 88 into contact with the contact member 106 (with reference to FIG. 3). As a result, as shown in FIG. 9B, the carriage 38 is moved upward, thereby causing the optical sensor 70 to be distant from the platen 42 by the second distance $h_2$. The controller 100 controls the carriage 38 to be moved in the width direction 122 to the generally central position of the guide frames 43, 44 in the width direction 122 such that the gap adjusting member 88 is not brought into contact with the contact member 107. As a result, the optical sensor 70 is disposed on the upper side of the recording sheet 50 in the state in which the optical sensor 70 is disposed at the second position.

In a fourth step, the controller 100 controls the light emitting element 67 to emit the light with the intensity S the same as at the calibration in the state in which the optical sensor 70 is disposed at the second position. This light is reflected from the surface of the recording sheet 50 and received by the light receiving element 68. The light receiving element 68 outputs to the controller 100 the second voltage signal according to the intensity of the received light. The controller 100 temporarily stores the voltage value $V_2$ of the thus obtained second voltage signal into the RAM 103.

In a fifth step, the distance G between the optical sensor 70 and the recording sheet 50 on the platen 42, or the reflectivity R of the surface of the recording sheet 50 is calculated on the basis of the voltage value $V_1$ and the voltage value $V_2$ respectively obtained in the second step and the fourth step. Where calculating the distance Q the controller 100 reads out equation (1), the first distance $h_1$, the distance $d_0$, and the gap change $\Delta h$ from the ROM 102, and also reads out the voltage value $V_{01}$ of the first reference voltage and the voltage value $V_{02}$ of the second reference voltage from the EEPROM 104. Then, the controller 100 substitutes, into equation (1), the first distance $h_1$, the distance $d_0$, the gap change $\Delta h$, the voltage value $V_{01}$, the voltage value $V_{02}$, and the voltage value $V_1$ of the first voltage signal, and the voltage value $V_2$ of the second voltage signal stored in the RAM 103. As a result, the distance G between the optical sensor 70 and the recording sheet 50 is obtained.

As thus described, the controller 100 calculates the distance G on the basis of the voltage value $V_1$ of the first voltage signal, the voltage value $V_2$ of the second voltage signal, the voltage value $V_{01}$ of the first reference voltage, and the voltage value $V_{02}$ of the second reference voltage. It is noted that the distance G is changed depending upon not only the thickness of the recording sheet 50 but also floating of the recording sheet 50 from the platen 42.

Where calculating the reflectivity R of the surface of the recording sheet 50, the controller 100 reads out equation (2) and the reflectivity $R_0$ from the ROM 102 and also reads out the voltage value $V_{01}$ of the first reference voltage and the voltage value $V_{02}$ of the second reference voltage from the EEPROM 104. Then, the controller 100 substitutes, into equation (2), the voltage value $V_{01}$, the voltage value $V_{02}$, and the reflectivity $R_0$, and the voltage value $V_1$ of the first voltage signal and the voltage value $V_2$ of the second voltage signal stored in the RAM 103. As a result, the reflectivity R of the surface of the recording sheet 50 is obtained.

Meanwhile, in the present embodiment, in the sheet-supply tray 20 is accommodated the normal sheet or the glossy sheet as the recording sheet 50. A surface of the glossy sheet has a higher light reflectivity than that of the normal sheet. Thus, where the recording sheet 50 on the platen 42 is the glossy sheet, the reflectivity R is relatively high when compared with the case in which the recording sheet 50 is the normal sheet. The controller 100 reads out the second threshold value from the ROM 102 after calculating the reflectivity R. Then, the controller 100 judges whether the reflectivity R is equal to or higher than the second threshold value or not. Where the controller 100 has judged that the reflectivity R is equal to or higher than the second threshold value, the controller 100 can judge that the recording sheet 50 is the glossy sheet. On the other hand, where the controller 100 has judged that the reflectivity R is lower than the second threshold value, the controller 100 can judge that the recording sheet 50 is the normal sheet. As thus described, the controller 100 judges the type of the recording sheet 50 on the basis of the calculated reflectivity R and controls the image recording on the basis of a result of the judgment. That is, the controller 100 functions as a judging section configured to judge the type of the recording sheet 50.

<Effect of the Present Embodiment>

According to the present embodiment, the light with the constant intensity S is emitted from the light emitting element 67. Thus, the voltage signal outputted from the light receiving element 68 is determined by (a) the distance G between the optical sensor 70 and the surface of the recording sheet 50 and (b) the reflectivity R of the surface of the recording sheet 50. Thus, the distance G and the reflectivity R are expressed as equations (equation (1) and equation (2)) of the first voltage signal and the second voltage signal. The distance G and the reflectivity R are obtained by substituting the voltage value $V_1$ of the first voltage signal and the voltage value $V_2$ of the second voltage signal into equation (1) and equation (2). Thus, the distance G or the reflectivity R can be easily obtained using the optical sensor 70 constituted by the pair of the light emitting element 67 and the light receiving element 68 which are integrally constructed with each other. It is noted that, in the above-described embodiment, the optical sensor is constituted by the pair of the light emitting element 67 and the light receiving element 68 which are integrally constructed with each other, but the present invention is not limited to this configuration. That is, the light emitting element 67 and the light receiving element 68 may be independently mounted on the carriage 38.

According to the MFD 10 as the embodiment of the present invention, the distance G and the reflectivity R can be accurately obtained with small increase in cost.

It is noted that, in the present embodiment, there has been explained the embodiment in which the carriage 38 is moved in the vertical direction relative to the platen 42 in order to change the distance between the optical sensor 70 and the platen 42. Instead, the MFD 10 may be configured such that the platen 42 is movable in the vertical direction toward and away from the carriage 38. Further, in the present embodiment, the carriage 38 is moved upward and downward relative to the platen 42 in order to change the distance between the optical sensor 70 and the platen 42, but, instead of this configuration, the distance between the optical sensor 70 and the platen 42 may be changed by making the distance between the platen 42 and the carriage 38 constant and changing the vertical position of the optical sensor 70 in the carriage.

Further, in the present embodiment, there has been explained the embodiment in which one distance G and one reflectivity R are calculated in a state in which the optical sensor 70 is disposed at the position in the width direction 122 (i.e., the generally central position of the guide frames 43, 44 in the width direction 122). Instead, the controller 100 may obtain a plurality of the voltage values $V_1$, $V_2$ while displacing or shifting the position of the optical sensor 70 (i.e., the position of the carriage 38) in the width direction 122 and calculate the distance G and the reflectivity R at each position.

As a result, the controller 100 can detect bending or deformation of the recording sheet 50.

Further, in the present embodiment, the first distance $h_1$, the distance $d_0$, and the gap change $\Delta h$ stored in the ROM 102, and the voltage value $V_{01}$ and the voltage value $V_{02}$ stored in the EEPROM 104 among variables in equation (1) are known values. Thus, by substituting these known values into equation (1) in advance, the distance G can be expressed as a function using, as variables, only the voltage value $V_1$ of the first voltage signal and the voltage value $V_2$ of the second voltage signal which signals are outputted from the light receiving element 68 of the optical sensor 70. That is, this function may be stored in the ROM 102 (or the EEPROM 104) instead of equation (1).

Further, there has been explained the embodiment in which the second voltage signal is obtained after the first voltage signal is obtained, but the first voltage signal may be obtained after the second voltage signal is obtained. That is, the third step and the fourth step may be performed in advance of the first step and the second step. In this case, the third step may be omitted where the optical sensor 70 has already been disposed at the second position in an initial state of the MFD 10.

As described above, in the present embodiment, at the calibration, the test paper is disposed on the platen 42, so that the light emitted from the light emitting element 67 is reflected from the surface of the test paper and received by the light receiving element 68, whereby the first reference voltage and the second reference voltage are outputted, but the present invention is not limited to this configuration. For example, the MFD 10 can be configured such that in a state in which the test paper is not disposed on the platen 42, the light emitted from the light emitting element 67 is reflected by the surface of the platen 42, and the reflected light is detected by the light receiving element 68, whereby the first reference voltage and the second reference voltage are obtained. In this case, the distance G can be obtained by the above-described equation (1), and the reflectivity R can be obtained by the following equation (14) (Rp: a light reflectivity of the surface of the platen 42).

$$R = \frac{V_1 + V_2}{V_{01} + V_{02}} R_P \tag{14}$$

Further, the platen 42 may include a plurality of ribs which extend in the sheet-feed direction 17 and are parallel to each other, in order to reduce sheet feeding resistance. That is, it can be considered that where the light from the light emitting element 67 is emitted to the platen 42, the light is reflected from a planar portion of the platen 42 which is formed between adjacent ones of the ribs of the platen 42. In this case, where it is defined that the distance $d_0$ takes a positive value where the reflection surface is above the level of distal ends of the respective ribs while the distance $d_0$ takes a negative value where the reflection surface is below the level of distal ends of the respective ribs, the distance $d_0$ takes the negative value where the planar portion of the platen 42 between the ribs functions as the reflection surface. Also in the case where the thus palten 42 is used, the distance G can be obtained by equation (1), and the reflectivity R can be obtained by equation (14) (Rp: a light reflectivity of the planar portion of the platen 42 which is formed between the ribs).

What is claimed is:

1. An image recording apparatus, comprising:

a platen configured to support a sheet fed along a predetermined sheet-feed path;

a carriage disposed so as to face to the platen and configured to be movable in a first direction intersecting a sheet-feed direction in which the sheet is fed;

a recording head mounted on the carriage and configured to record an image on the sheet fed along the platen;

an optical sensor mounted on the carriage and constituted by (a) a light emitting element configured to emit light with predetermined intensity toward a surface facing to the recording head and (b) a light receiving element configured to receive light reflected from the surface facing to the recording head and output an electric signal according to intensity of the reflected light;

a changing mechanism configured to change a position of the optical sensor between (a) a first position distant from the platen by a first distance and (b) a second position distant from the platen by a second distance which is different from the first distance; and a calculation section configured to calculate at least one of (a) a distance between the optical sensor and a surface of the sheet and (b) a light reflectivity of the surface of the sheet on the basis of a first electric signal and a second electric signal, wherein the first electric signal is outputted from the light receiving element by receiving light reflected from the sheet disposed on the platen by the light receiving element in a state in which the optical sensor is disposed at the first position while the second electric signal is outputted from the light receiving element by receiving the light reflected from the sheet disposed on the platen by the light receiving element in a state in which the optical sensor is disposed at the second position.

2. The image recording apparatus according to claim 1, wherein the changing mechanism is configured to change the position of the optical sensor between the first position and the second position by moving the carriage relative to the platen in a second direction in which the carriage is moved toward and away from the platen.

3. The image recording apparatus according to claim 2, wherein the carriage is supported by a guide frame via a sliding member so as to be allowed to be moved in the first direction, and wherein the changing mechanism is configured to change the position of the optical sensor between the first position and the second position by moving the carriage relative to the sliding member in the second direction.

4. The image recording apparatus according to claim 3, wherein the changing mechanism includes an adjusting member disposed between the carriage and the sliding member in the second direction, and wherein the changing mechanism is configured to change the position of the optical sensor between the first position and the second position by moving the adjusting member.

5. The image recording apparatus according to claim 4, wherein the adjusting member includes a thin part and a thick part whose thicknesses are different from each other in the second direction, and wherein the changing mechanism is configured to change a part of the adjusting member which is located between the carriage and the sliding member, in between a case in which the part is the thin part and a case in which the part is the thick part.

6. The image recording apparatus according to claim 5, wherein the adjusting member is configured such that a thickness thereof is changed in the first direction.

7. The image recording apparatus according to claim 6, wherein the changing mechanism is configured to move the adjusting member by moving the carriage in the first direction.

8. The image recording apparatus according to claim 7, wherein the adjusting member has a projecting portion projecting outward from an end portion of the carriage in the first direction, wherein the guide frame includes a contact member with which the projecting portion of the adjusting member is brought into contact when the carriage is moved in the first direction, and wherein the adjusting member is moved by receiving a force from the contact member of the guide frame.

9. The image recording apparatus according to claim 1, further comprising a storing section configured to store (a) a first reference signal outputted from the light receiving element by receiving the light reflected from the surface facing to the recording head by the light receiving element when the light with the predetermined intensity is emitted from the light emitting element in a state in which the optical sensor is disposed at the first position and (b) a second reference signal outputted from the light receiving element by receiving the light reflected from the surface facing to the recording head by the light receiving element when the light with the predetermined intensity is emitted from the light emitting element in a state in which the optical sensor is disposed at the second position, wherein the calculation section is configured to calculate the distance on the basis of the first electric signal, the second electric signal, the first reference signal, and the second reference signal.

10. The image recording apparatus according to claim 9, wherein each of the first reference signal and the second reference signal is a signal outputted by receiving light reflected from a reference sheet disposed on the platen by the light receiving element, wherein a reference distance is a distance from an upper surface of the platen to an upper surface of the reference sheet, and wherein the calculation section is configured to calculate the distance between the optical sensor and the surface of the sheet on the basis of the first electric signal, the second electric signal, the first reference signal, the second reference signal, and the reference distance.

11. The image recording apparatus according to claim 10, wherein the calculation section is configured to calculate the distance between the optical sensor and the surface of the sheet on the basis of the first electric signal, the second electric signal, the first reference signal, the second reference signal, the reference distance, the first distance, and the second distance.

12. The image recording apparatus according to claim 1, further comprising a storing section configured to store (a) a first reference signal outputted from the light receiving element by receiving the light reflected from the surface facing to the recording head by the light receiving element when the light with the predetermined intensity is emitted from the light emitting element in a state in which the optical sensor is disposed at the first position and (b) a second reference signal outputted from the light receiving element by receiving the light reflected from the surface facing to the recording head by the light receiving element when the light with the predetermined intensity is emitted from the light emitting element in a state in which the optical sensor is disposed at the second position, wherein the calculation section is configured to calculate the reflectivity of the surface of the sheet on the basis of the first electric signal, the second electric signal, the first reference signal, and the second reference signal.

13. The image recording apparatus according to claim 12, wherein each of the first reference signal and the second reference signal is a signal outputted by receiving light reflected from a reference sheet by the light receiving element, which reference sheet is disposed on the platen and whose reflectively is a first reflectivity, and wherein the calculation section is configured to calculate the reflectivity on the basis of the first electric signal, the second electric signal, the first reference signal, the second reference signal, and the first reflectivity.

14. The image recording apparatus according to claim 1, further comprising a judging section configured to judge a type of the sheet on the basis of the reflectivity calculated by the calculation section.

15. The image recording apparatus according to claim 1, further comprising a detecting section configured to detect, as an end portion of the sheet in the first direction, the position of the optical sensor in the first direction when the electric signal outputted from the light receiving element becomes a predetermined value.

16. The image recording apparatus according to claim 1, wherein the changing mechanism is configured to change the position of the optical sensor between the first position and the second position by moving the carriage in the first direction.

17. A calculation method for calculating at least one of (a) a distance between an optical sensor mounted in an image recording apparatus and a surface of a sheet placed in the image recording apparatus and (b) a light reflectivity of the surface of the sheet, comprising the steps of, in the image recording apparatus configured such that a carriage on which the optical sensor constituted by a light emitting element and a light receiving element is mounted is movable in a first direction intersecting a sheet-feed direction in which the sheet is fed:

disposing the optical sensor at a first position distant from a platen facing to the carriage by a first distance by moving the carriage relative to the platen in a second direction in which the carriage is moved toward and away from the platen;

obtaining a first electric signal outputted from the light receiving element by receiving light reflected from the sheet disposed on the platen by the light receiving element in a state in which the optical sensor is disposed at the first position;

disposing the optical sensor at a second position distant from the platen by a second distance which is different from the first distance by moving the carriage relative to the platen in the second direction;

obtaining a second electric signal outputted from the light receiving element by receiving the light reflected from the sheet disposed on the platen by the light receiving element in a state in which the optical sensor is disposed at the second position; and calculating at least one of (a) the distance between the optical sensor and the surface of the sheet and (b) the light reflectivity of the surface of the sheet on the basis of the first electric signal and the second electric signal.

18. The calculation method according to claim 17, further comprising the steps of:

obtaining a first reference signal outputted from the light receiving element by receiving light reflected from a surface facing to the recording head by the light receiving element when light with predetermined intensity is emitted from the light emitting element in the state in which the optical sensor is disposed at the first position; and obtaining a second reference signal outputted from the light receiving element by receiving the light reflected from the surface facing to the recording head by the light receiving element when the light with the predetermined intensity is emitted from the light emitting element in the state in which the optical sensor is disposed at the second position, wherein the calculating step is a step for calculating the distance on the basis of the first electric signal, the second electric signal, the first reference signal, and the second reference signal.

19. The image recording apparatus according to claim 17, further comprising:

a step of obtaining a first reference signal outputted from the light receiving element by receiving light reflected from a surface facing to the recording head by the light receiving element when the light with the predetermined intensity is emitted from the light emitting element in a state in which the optical sensor is disposed at the first position; and a step of obtaining a second reference signal outputted from the light receiving element by receiving the light reflected from the surface facing to the recording head by the light receiving element when the light with the predetermined intensity is emitted from the light emitting element in a state in which the optical sensor is disposed at the second position, wherein the calculation section is configured to calculate the reflectivity of the surface of the sheet on the basis of the first electric signal, the second electric signal, the first reference signal, and the second reference signal.

* * * * *